US011805908B2

(12) United States Patent
Jakubowski et al.

(10) Patent No.: US 11,805,908 B2
(45) Date of Patent: Nov. 7, 2023

(54) RECLINER WITH FORCE-LIMITED STABILIZER ARMS

(71) Applicant: Direct Supply, Inc., Milwaukee, WI (US)

(72) Inventors: Joshua Jakubowski, Port Washington, WI (US); Justin T. Morgan, Cedarburg, WI (US)

(73) Assignee: Direct Supply, Inc., Milwaukee, WI (US)

( * ) Notice: Subject to any disclaimer, the term of this patent is extended or adjusted under 35 U.S.C. 154(b) by 0 days.

(21) Appl. No.: 17/811,637

(22) Filed: Jul. 11, 2022

(65) Prior Publication Data

US 2022/0338634 A1 Oct. 27, 2022

Related U.S. Application Data

(63) Continuation-in-part of application No. 17/155,388, filed on Jan. 22, 2021, now Pat. No. 11,406,190.

(60) Provisional application No. 62/985,543, filed on Mar. 5, 2020.

(51) Int. Cl.

| | |
|---|---|
| ***A47B 67/04*** | (2006.01) |
| ***A47B 97/00*** | (2006.01) |
| ***A47K 1/04*** | (2006.01) |
| ***A47C 7/50*** | (2006.01) |
| ***A47C 1/027*** | (2006.01) |
| ***A47C 1/0355*** | (2013.01) |
| ***A47C 7/00*** | (2006.01) |

(52) U.S. Cl.

CPC ..... *A47C 1/0355* (2013.01); *A47B 97/00* (2013.01); *A47C 7/006* (2013.01); *A47B 2097/008* (2013.01)

(58) Field of Classification Search

CPC ..... B60N 2/753; B60N 2/767; A47C 1/023; A47C 1/03; A47C 7/506; A47C 7/54

See application file for complete search history.

(56) References Cited

U.S. PATENT DOCUMENTS

| | | | | |
|---|---|---|---|---|
| 7,871,046 | B2 * | 1/2011 | Munro | B65G 1/026 248/346.02 |
| 8,459,732 | B2 * | 6/2013 | LaPointe | A47C 1/0355 297/260.2 |
| 9,861,194 | B1 * | 1/2018 | Park | A47B 67/04 |
| 10,820,708 | B2 * | 11/2020 | LaPointe | A47C 7/506 |
| 2007/0132292 | A1 * | 6/2007 | Robertson | A47C 1/0242 297/330 |
| 2015/0076891 | A1 * | 3/2015 | LaPointe | A47C 31/008 297/85 M |
| 2015/0359692 | A1 * | 12/2015 | Elnatan | A63B 21/4011 297/183.1 |
| 2019/0082837 | A1 * | 3/2019 | Kim | A47B 91/06 |
| 2019/0183248 | A1 * | 6/2019 | Chen | F16F 13/002 |
| 2019/0350368 | A1 * | 11/2019 | Lapointe | A47C 1/0355 |
| 2020/0046119 | A1 * | 2/2020 | Katayama | A47B 97/00 |
| 2020/0107641 | A1 * | 4/2020 | Weldon | A47C 13/00 |
| 2020/0113333 | A1 * | 4/2020 | Crum | A47C 1/0355 |

(Continued)

*Primary Examiner* — Shin H Kim

(74) *Attorney, Agent, or Firm* — Boyle Fredrickson, S.C.

(57) ABSTRACT

A reclining chair or the like provides a set of base-mounted extendable arms that extend outward as the chair reclines to brace the chair against tipping. A force-limiting coupler allows the reclining mechanism and the extendable arms to be linked while maintaining different force regimes.

12 Claims, 15 Drawing Sheets

(56) References Cited

U.S. PATENT DOCUMENTS

| | | | | |
|---|---|---|---|---|
| 2020/0196759 | A1* | 6/2020 | Johnson | A47C 1/0355 |
| 2021/0274938 | A1* | 9/2021 | Jakubowski | A47B 97/00 |

* cited by examiner

FIG. 15
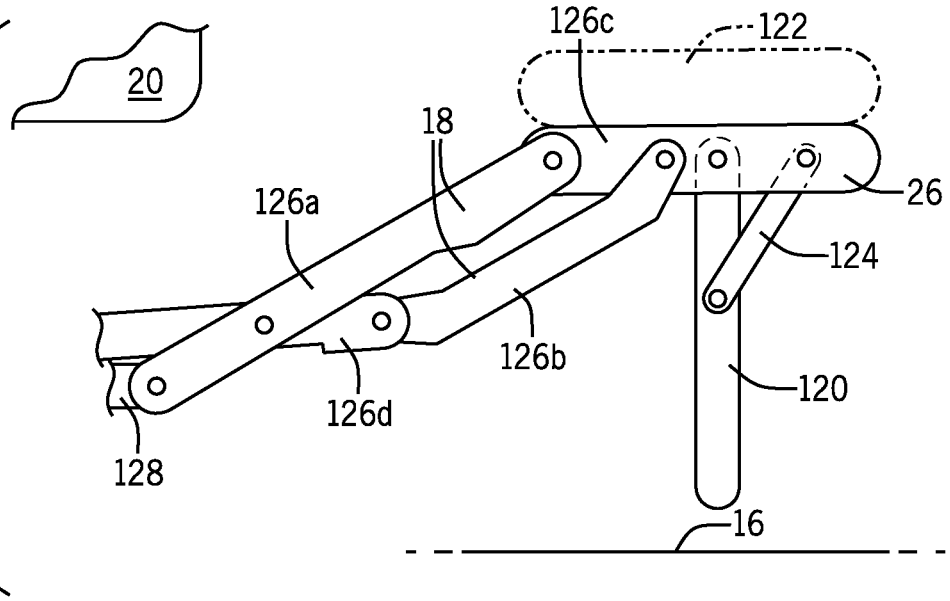
FIG. 16
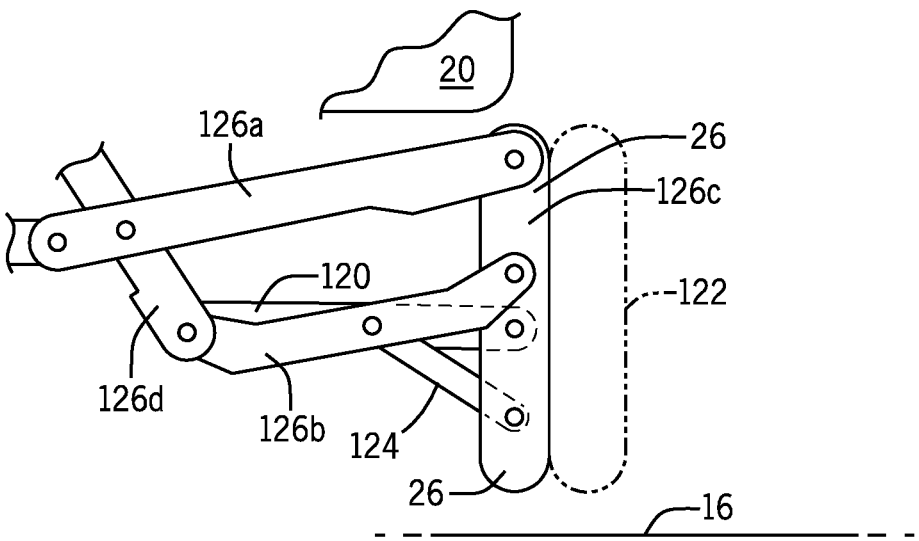
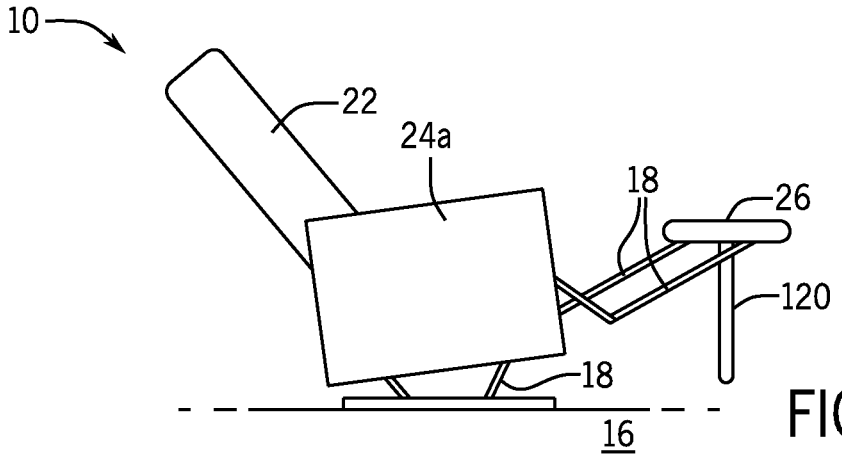
FIG. 17

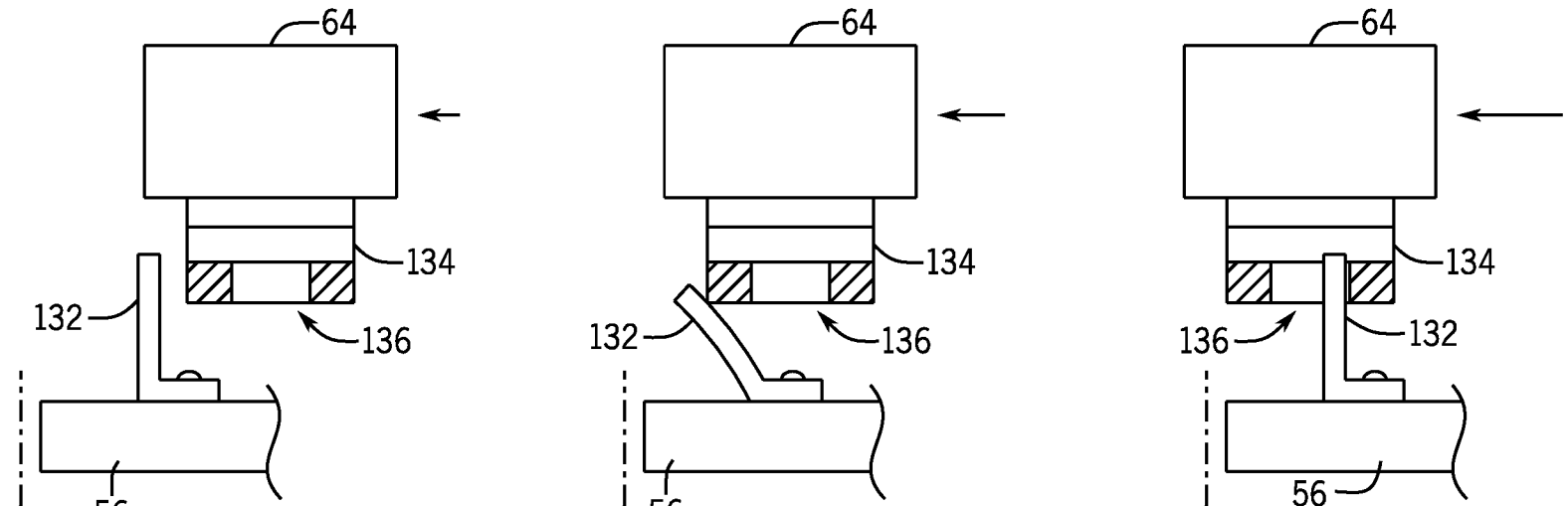
FIG. 22a
FIG. 22b
FIG. 22c
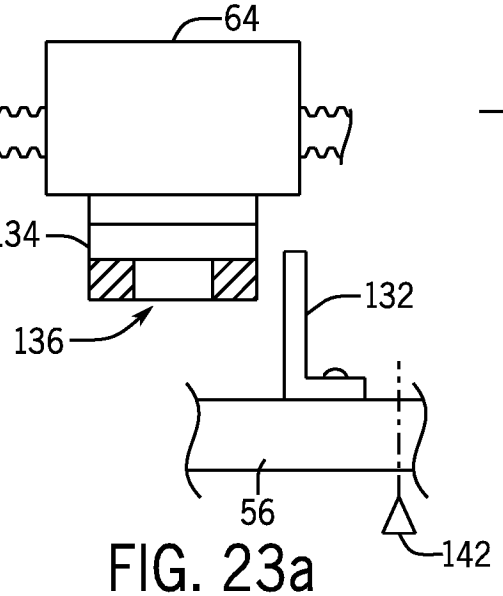
FIG. 23a
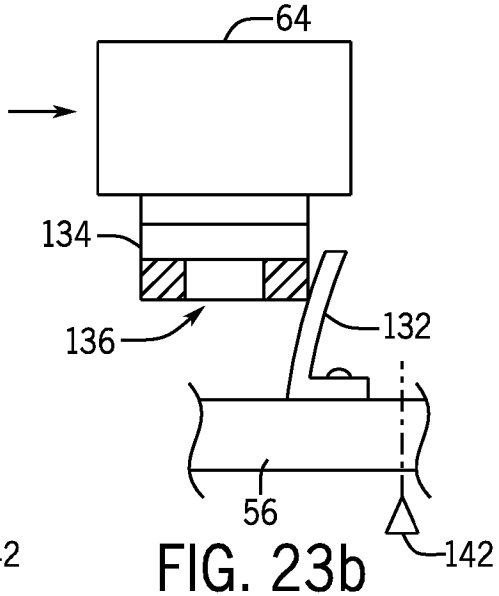
FIG. 23b
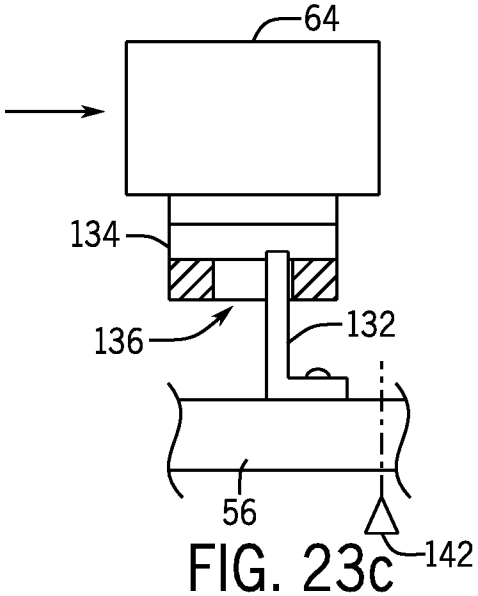
FIG. 23c

RECLINER WITH FORCE-LIMITED STABILIZER ARMS

CROSS REFERENCE TO RELATED APPLICATION

This application is a continuation-in-part of U.S. application Ser. No. 17/155,388 filed Jan. 22, 2021, claiming the benefit of U.S. provisional application 62/985,543 filed Mar. 5, 2020, all hereby incorporated by reference.

STATEMENT REGARDING FEDERALLY SPONSORED RESEARCH OR DEVELOPMENT

- - -

BACKGROUND OF THE INVENTION

The present invention relates generally to recliner chairs and similar furniture providing a reclining seat back and forwardly extending footrest and, in particular, to a stabilizer system improving the stability of such furniture when the furniture is in the reclined position.

A common recliner chair provides an upwardly extending rear seat back that may be reclined by tipping backward with respect to the seat pan supporting the seated individual. Reclining motion of the seat back may be coordinated to a simultaneous elevation and extension of a footrest by means of a mechanical linkage between these two elements. As the seat back reclines and the footrest extends, the seat pan may also be tipped back slightly by the mechanical linkage so that the seated individual more closely approaches relaxing in a supine position.

The reclining mechanism may be operated by a lever communicating with the mechanical linkage. This lever may be positioned at a side of the seat pan, for example, outside the arms of the chair, to be operated by a seated individual and pulled to promote the reclining action. Alternatively, the reclining mechanism may be driven by a motor and controlled by the seated individual through a control pendant providing electrical switches controlling electrical current to the motor.

With so-called "wall-saver" reclining chairs, the reclining mechanism further moves the seat pan forward over a base that sits against the floor. Specifically, during the reclining action, the seat pan slides forward with respect to the base carrying with it the reclining seat back and footrest. In this way the reclining chair may be placed with its rear in closer proximity to a wall without the reclining of the seat back striking that wall during the reclining process.

Particularly when a wall-saver design is used with a motor actuator, there can be an increased risk of instability in the chair if the seated individual attempts to exit the chair forward over the extended footrest. Forward movement of the seat pan with respect to the base during reclining moves the center of mass of the chair forward with respect to the base which can be further shifted as the individual attempts to disembark. In such cases, the natural resistance of the motorized mechanism resists returning the chair to an upright and more stable position, allowing the chair to tip forward in certain cases.

U.S. patent application Ser. No. 17/155,388, assigned to the assignee of the present invention and hereby incorporated by reference, discloses extendable stabilizer arms that automatically move outward from the base of the chair to contact the floor surface in front of and/or behind the chair when the chair is in the reclined position. These arms provide stability without adding to the mass of the base of the chair that would make the chair difficult to position or relocate.

SUMMARY OF THE INVENTION

The present inventors have recognized that linking the stabilizer arms to the recliner mechanism, to realize the benefit of automatic extension, can result in undesirably large forces being applied to the extension arms when they are obstructed. These large forces are the result of the necessarily higher forces and momentum associated with the reclining of the chair. The present invention addresses this problem by placing a force-limiting coupler between the recliner mechanism and the stabilizer arms which not only operates to limit the forces on the stabilizer arms in both extension and retraction but which automatically resets itself when the stabilizer arms are no longer obstructed, either reconnecting or realigning the recliner linkage with the stabilizer arms upon a cycling of the chair between reclining and upright positions.

More specifically then, in one embodiment, the invention provides a reclining chair having a base frame, a seat pan, a seat back, and a leg rest intercommunicating by a linkage supported by the base frame to move the reclining chair between a retracted position with the seat back upright and the leg rest retracted and an extended position with the seat back reclined rearwardly and the leg rest extended forwardly. At least one extendable arm is supported by the base frame and has a distal end movable between a retracted position and an extended position in which the distal end moves forward from the base frame so that the distal end contacts a floor surface to resist forward tipping of the base frame on the floor. The extendable arm communicates with the linkage through a force-limiting coupler operating to provide independent movement of the linkage and the extendable arm when a predetermined coupling force is exceeded and to provide a restoration of tandem motion of the linkage after the predetermined coupling force is no longer exceeded.

It is thus a feature of at least one embodiment of the invention to limit excessive force on the stabilizer arms when coupled to the structure of the chair recliner mechanism as is desirable for automatic operation.

The predetermined force may be between 30 and 50 pounds of force on the extendable arm.

It is thus a feature of at least one embodiment of the invention to balance reliable operation of the extension arms, for example, on resilient flooring material such as carpet and the like which can resist movement of the extension arms, with protection against excessive force when the extension arms are obstructed.

The linkage may include a traveler moving between a first and second position corresponding to the extended and retracted position of the reclining chair, and the force-limiting coupler may communicate between the traveler and the extendable arm allowing the traveler and extendable arm to move in tandem when the predetermined coupling force is not exceeded. The extendable arm may be constrained by stops against further motion when the traveler is in the first or second position.

It is thus a feature of at least one embodiment of the invention to allow the relationship between the linkage and the extendable arm (in positional registration and coupling) to be restored by providing stops on the extendable arm that allow a restoring force to be applied by the coupling by the linkage during cycling of the recliner chair.

The force-limiting coupler may disconnect the linkage and the extendable arm when the predetermined coupling force is exceeded and reconnect the linkage and the extendable arm when the predetermined coupling force is no longer exceeded and after one cycle of the reclining chair between the retracted position and extended position is completed.

It is thus a feature of at least one embodiment of the invention to fully disconnect the stabilizer arms when the predetermined forces are exceeded such as may be desirable, for example, to allow manual disengagement of the stabilizer arms from an obstruction while allowing automatic reconnection.

In this embodiment, the force-limiting coupler may be an inter-engaging finger and socket having a spring-biased connection released at the predetermined force.

It is thus a feature of at least one embodiment of the invention to provide a mechanically simple yet robust interconnection between the linkage and the extendable arm that can be separated upon a predetermined force and readily reconnected, for example, once an obstruction is removed.

At least one of the finger and socket may flex along a direction of travel of the extendable arm as a function of the coupling force to disconnect the finger and socket when the predetermined coupling force is exceeded.

It is thus a feature of at least one embodiment of the invention to provide a simple force-limited connection implemented by a laterally flexing spring element.

The socket may provide an opening larger in a vertical extent than a received portion of the finger to allow a predetermined relative vertical displacement between the socket and finger while connected.

It is thus a feature of at least one embodiment of the invention to allow a coupling that can accommodate a misalignment between elements of the linkage and the extendable arm found in existing reclining chairs where a motor track is tipped to accommodate complex linkage movement.

In one alternative embodiment, the force-limiting coupler may provide a force-limited sliding between the linkage and extendable arm from a registered to an unregistered position when the predetermined coupling force is exceeded and may return the linkage and the at least one extendable arm to the registered position when the predetermined coupling force is no longer exceeded and one cycle of the reclining chair between the retracted position and extended position is completed.

It is thus a feature of at least one embodiment of the invention to provide a continuous connection between the linkage and the extendable arm that is nevertheless force-limited.

In this regard, in one embodiment, the force-limiting coupler may provide frictional surfaces attached to each of the motorized traveler and extendable arm and spring biased into frictional engagement.

It is thus a feature of at least one embodiment of the invention to employ the properties of static friction and dynamic friction to define a predetermined force-limiting.

In one embodiment, the force-limiting coupler provides interengaging teeth attached respectively to the motorized traveler and extendable arm and spring biased into engagement.

It is thus a feature of at least one embodiment of the invention to provide the benefits of continuous coupling between the linkage and the extendable arm while avoiding the complexities of frictional engagement that may change over time or require excessive forces.

The reclining chair may include two stabilizer arms each having an independent corresponding force-limiting coupler.

It is thus a feature of at least one embodiment of the invention to maintain partial chair stability when one of the stabilizer arms may be obstructed by allowing the other stabilizer arm to operate normally.

The reclining chair may further include a motor communicating with the linkage and actuable to move the reclining chair between the retracted position and extended position.

It is thus a feature of at least one embodiment of the invention to provide a system working with motor-actuated reclining chairs which may provide higher linkage forces that are not naturally moderated by human actuation of a lever or the like.

These particular objects and advantages may apply to only some embodiments falling within the claims and thus do not define the scope of the invention.

BRIEF DESCRIPTION OF THE DRAWINGS

FIGS. 15 and 16 are fragmentary side elevational views of alternative embodiments of a stabilizing feature employing a stilt extending from the bottom of the footrest shown with the footrest extended in FIG. 14 and with the footrest retracted in FIG. 15;

FIG. 17 is a simplified side elevational view of the entire chair and footrest in the extended position of FIG. 14;

FIGS. 22*a-c* are figures similar to FIG. 20 showing reconnection of the coupler during a cycling of the traveler rearwardly with the extendable arm blocked by a rearward stop;

FIGS. 23*a-c* are figures similar to FIG. 21 showing reconnection of the coupler during a cycling of the traveler forwardly with the extendable arm blocked by a forward stop;

DETAILED DESCRIPTION OF THE PREFERRED EMBODIMENT

Chair and Stabilizing Arm Description

Figure 1:
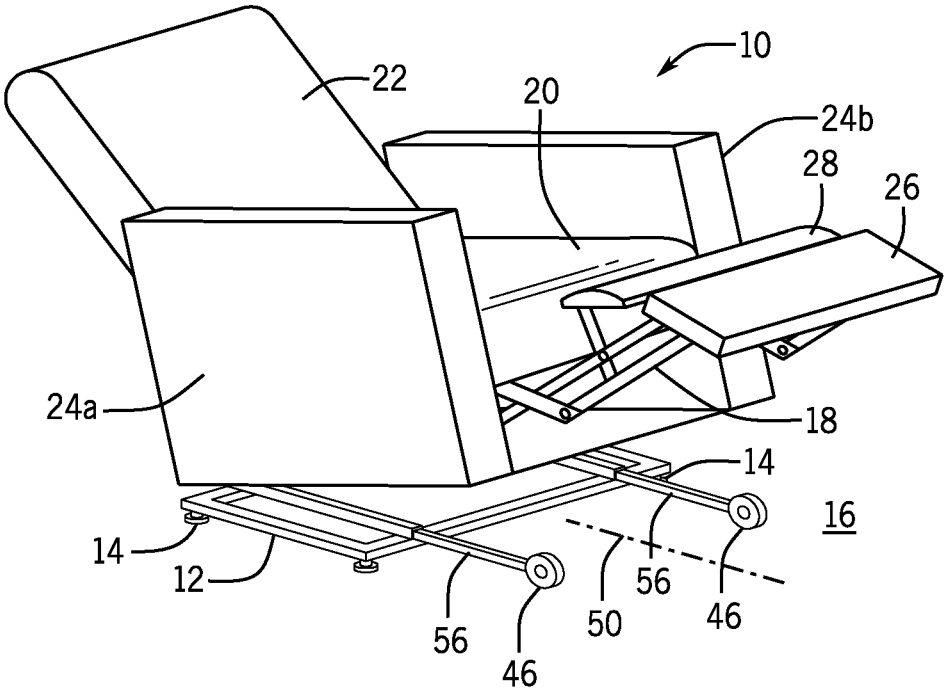
FIG. 1 is a perspective view of a reclining chair according to one embodiment of the present invention showing stabilizing arms extending along a forward axis during reclining of the chair.

Referring now to FIG. 1, a reclining chair 10 suitable for use with the present invention may include a base 12 supporting the chair 10 on a floor 16 such as a solid material, carpet, or the like. The base 12 may be a square or rectangular frame of steel or the like having downward feet 14 such as glides at its corners providing contact areas with the floor 16. In one embodiment, the base 12 may provide for left and right base bars 15*a* and 15*b* joining front and rear base bars 15*c* and 15*d* to form the rectangular frame.

The base 12 attaches to a recliner linkage 18 (shown in part) which in turn connects the base 12 to the remaining of the components of the chair including: a seat pan 20, a seat back 22, left and right arms 24*a* and 24*b*, a leg rest 26, and a calf rest 28. As is generally understood in the art, the seat pan 20 provides an upholstered upper surface for supporting a seated individual with the individual's back abutting an upholstered front surface of the seat back 22. As so seated, the individual's arms may rest on upper edges of the left and right arms 24*a* and 24*b* with the individual's calves and feet supported, respectively, on the calf rest 28 and leg rest 26.

Figure 2A:
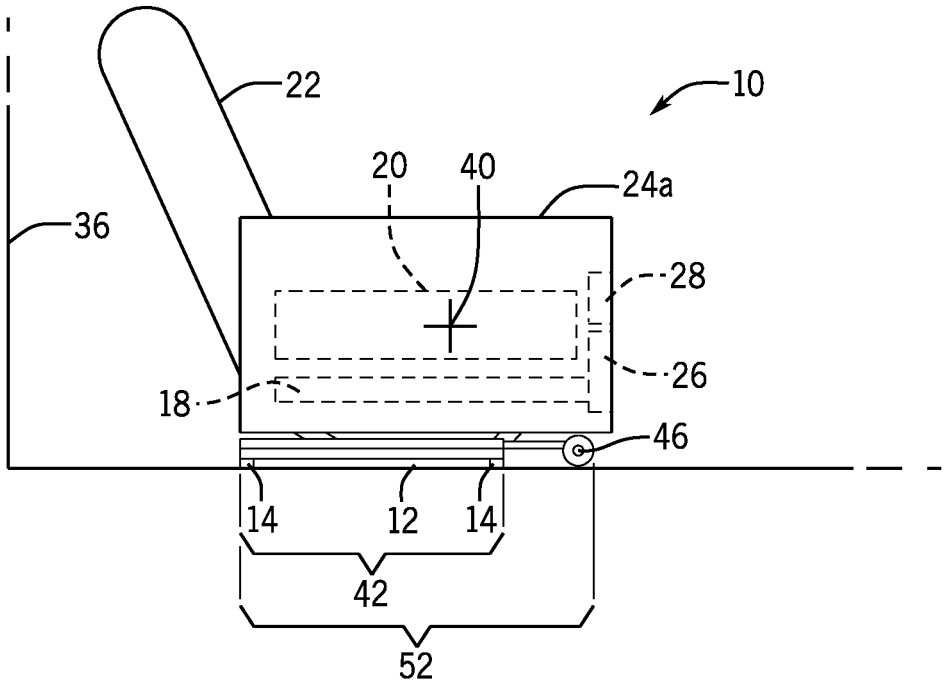
FIGS. 2*a* and 2*b* are side elevational views of the chair of FIG. 1 in an upright and reclined position, respectively, showing a forward shifting of the center of gravity of the chair with respect to the base as the chair reclines and a further shifting of the center of gravity as an individual disembarks.
Figure 2B:
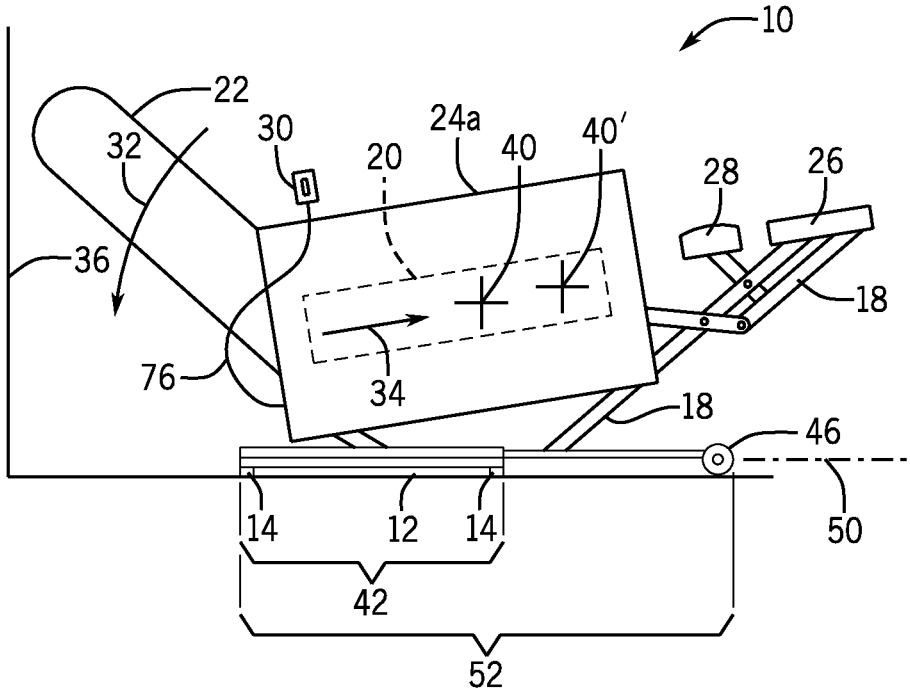

Referring now also to FIGS. 2*a* and 2*b*, in an upright position, as shown in FIG. 2*a*, the seat pan 20 will be generally horizontal and centered above the base 12 with the front surface of the seat back 22 extending upward from a rear edge of the seat pan 20 tipped backward slightly with respect to a vertical plane. In this position, a center of gravity 40 of the chair and a seated individual will generally be low and positioned inside a stability region 42 defined by a region within a rectangle whose vertices are the feet 14.

By activating a pendant control box 30, a seated user (not shown) can cause the chair 10 to move to a reclined position, shown in FIG. 2*b*, with the seat back 22 tipping further backward as shown by arrow 32 and the seat pan 20 moving upward and forward as indicated by arrow 34. This motion of the seat pan 20 prevents the seat back 22 from striking a nearby wall 36 positioned rearward of the chair 10. Typically, as the seat pan 20 elevates and moves forward with respect to the base 12, its front edge rises to follow the elevating calf rest 28 and leg rest 26 folding out from a front surface of the chair 10 below the upper surface of the seat pan 20.

Normally, as the chair 10 reclines, the center of gravity 40 moves forward but remains within the feet 14 in stability region 42. However, if the seated individual shifts forward attempting to exit the reclined chair over the calf rest 28 and 26, the center of gravity may move to center of gravity 40' outside of the stability region 42 causing a tipping of the chair forward and possibly over with possible risk to the occupant.

These features of the reclining chair 10 discussed above are generally understood in the art, for example, as described in U.S. Pat. No. 8,459,732 here by incorporated in its entirety by reference.

Referring still to FIGS. 1 and 2, in the present invention, a reclining of the chair 10 extends stabilizer arms 56 having distal rollers 46 along forward-axis 50 from the base 12. The forward-axis 50 generally passes from a rear to a front of the chair 10 along a midline of the chair 10, and desirably the stabilizing arms flank the midline to be closer to the left and right edges of the reclining chair 10 than to the midline.

The stabilizer arms 56 expand the stability region 42 to an augmented stability region 52 extending forward from the chair, for example, by at least 10 inches and typically more than 12 inches. When the chair 10 is in the upright position, the augmented stability region 52 is only slightly larger in area than stability region 42 as shown in FIG. 2*a*. On the other hand, when the chair 10 is in the reclined position, the augmented stability region increases over the area of the stability region 42 by more than 30 percent and brings the center of gravity 40' into the augmented stability region 52 and thus provides improved stability of the chair 10 in situations involving disembarking by the seated individual.

Notably in both the upright position and the reclined position of the chair 10, the distal rollers 46 are protected under other chair structures defined by the seat pan 20, to be retracted under a front surface of the chair 10 in the upright position, and to be protected beneath the upwardly extended calf rest 28 and leg rest 26 of the chair in the reclined position. This protection reduces tripping hazard from the distal rollers 46 to passersby or individuals assisting those in the chair.

Figure 3:
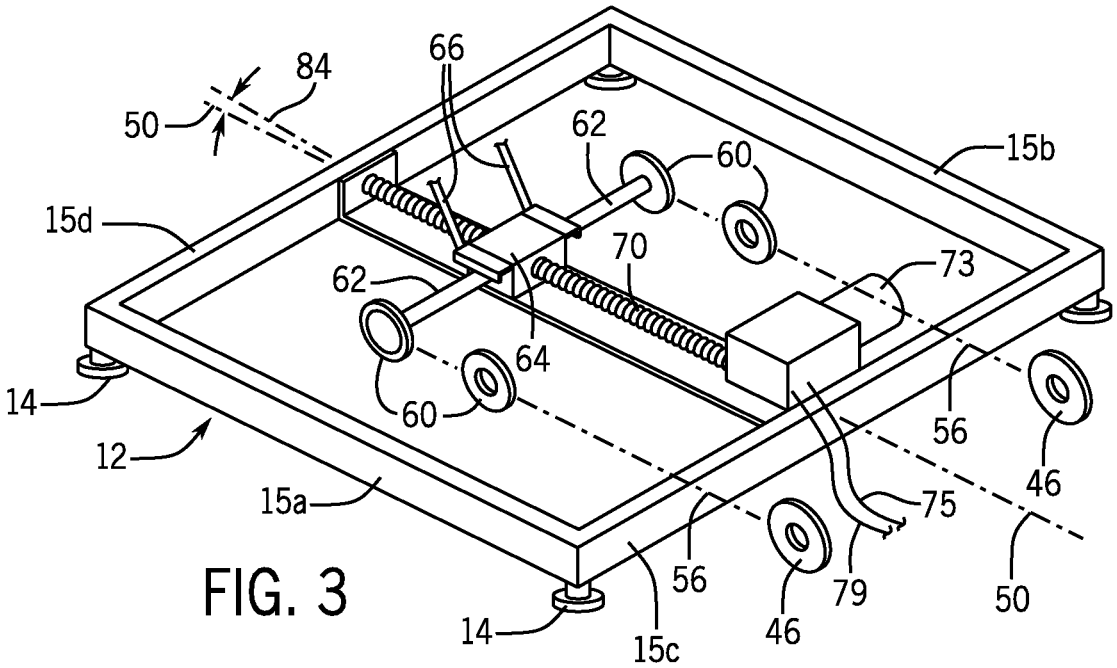
FIG. 3 is a simplified perspective view of the base of the chair of FIG. 1 showing an internal motorized track used to drive the reclining mechanism that may be used also to drive the stabilizing arms.

Referring now to FIGS. 1 and 3, the distal rollers 46 may extend in cantilevered fashion on the stabilizer arms 56 (abstracted to dotted lines for clarity) extending parallel to forward-axis 50 at a right side and left side of the base 12. Generally, the stabilizer arms 56 will be a sturdy metal material to prevent significant flexure of the stabilizer arms 56 when they serve to stabilize the chair 10 against the offset weight of an individual at a center of gravity 40'. The distal rollers 46 may be, for example, ball bearing wheels having an outer soft urethane or other elastomeric coating or outer layer to move along the floor 16 during extension without substantial frictional resistance between the distal rollers 46 and the floor 16 while still maintaining close contact with the floor 16.

The stabilizer arms 56 are connected to support wheels 60 that allow a low friction sliding motion of the stabilizer arms 56 along the forward-axis 50 as depicted between FIGS. 2*a* and 2*b* while resisting upward twisting on the stabilizer arms 56 that would cause them to deviate from their parallel extension with respect forward-axis 50.

A proximal end of the stabilizer arms 56, for example, at the position of a rearward one of the wheels 60, may connect by a wheel axle 62 to a traveler 64 that may be moved by means of a motor 73 along the forward-axis 50. This traveler 64 also communicates via linkage arms 66 with the recliner linkage 18 as is generally understood in the art. The linkage arms 66 may, for example, be equivalent to linkage arms 82 and 80 shown in above-cited U.S. Pat. No. 8,459,732 and may communicate with a structure similar to the recliner linkage 18 discussed in that patent.

Generally, the traveler 64 may be driven by a lead screw 70 extending along forward-axis 50 and turned by the motor 73 receiving power from a power cable 75 and a signal along signal line 79 from control box 30 (shown in FIG. 2*b*).

Figure 4:
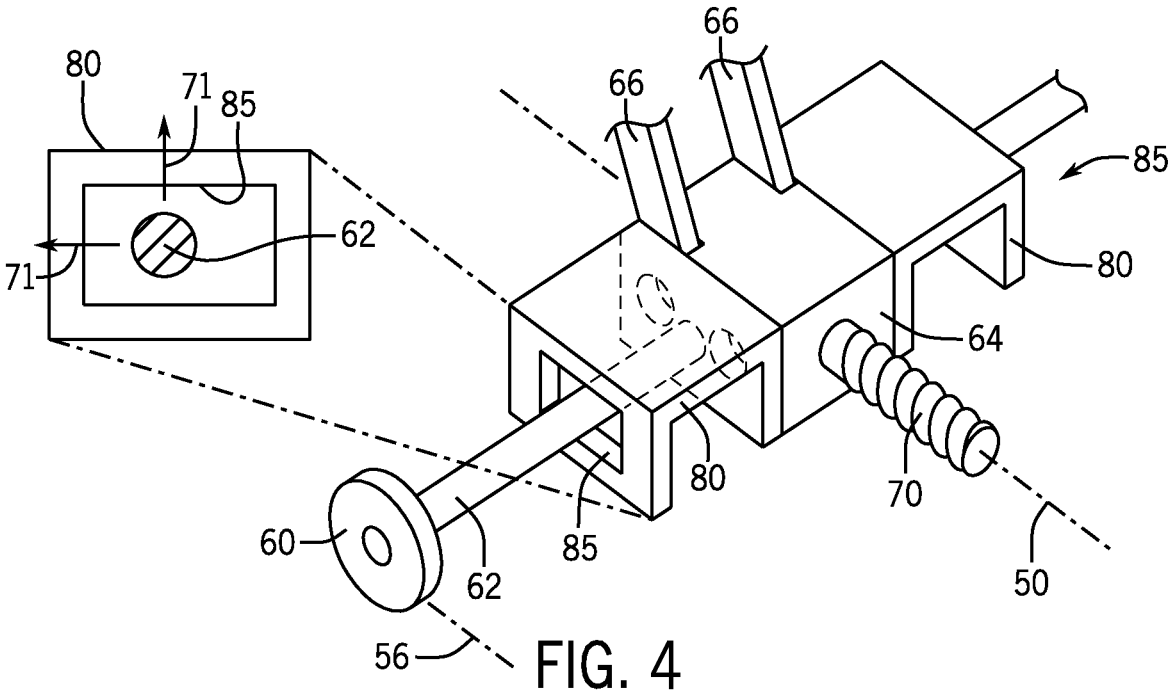
FIG. 4 is a perspective, fragmentary view of a traveler of the internal motorized track as attached to the stabilizing arms using a linkage which accommodates deviation in the motion of the traveler with respect to the motion of the stabilizing arms and showing, in inset, an elevational, cross-sectional view of a portion of that linkage.

Referring now to FIG. 4, the traveler 64 may provide left and right extending C channel brackets 80 opening downward. Each bracket 80 has one side of the C channel bolted to a corresponding side of the traveler 64 and the other side presenting outwardly exposed aperture 82. This aperture 82 may receive the wheel axle 62, described above, to move a respective stabilizing stabilizer arm 56 with motion of the traveler 64 to allow a slight degree of relative motion 71 in two perpendicular directions between the wheel axle 62 and the traveler 64 that accommodates with a slightly different trajectory between the lead screw 70 indicated by trajectory 84 and the horizontal trajectory of forward-axis 50 along which the stabilizer arms 56 extend. It will be appreciated that this aperture 82 may also allow relative motion between the wheel 60 and stabilizing stabilizer arm 56 and the traveler 64 when the traveler 64 is on a pivoting track, for example, as occurs when the reclining chair 10 allows rocking in its reclining or upright position.

Figure 5:
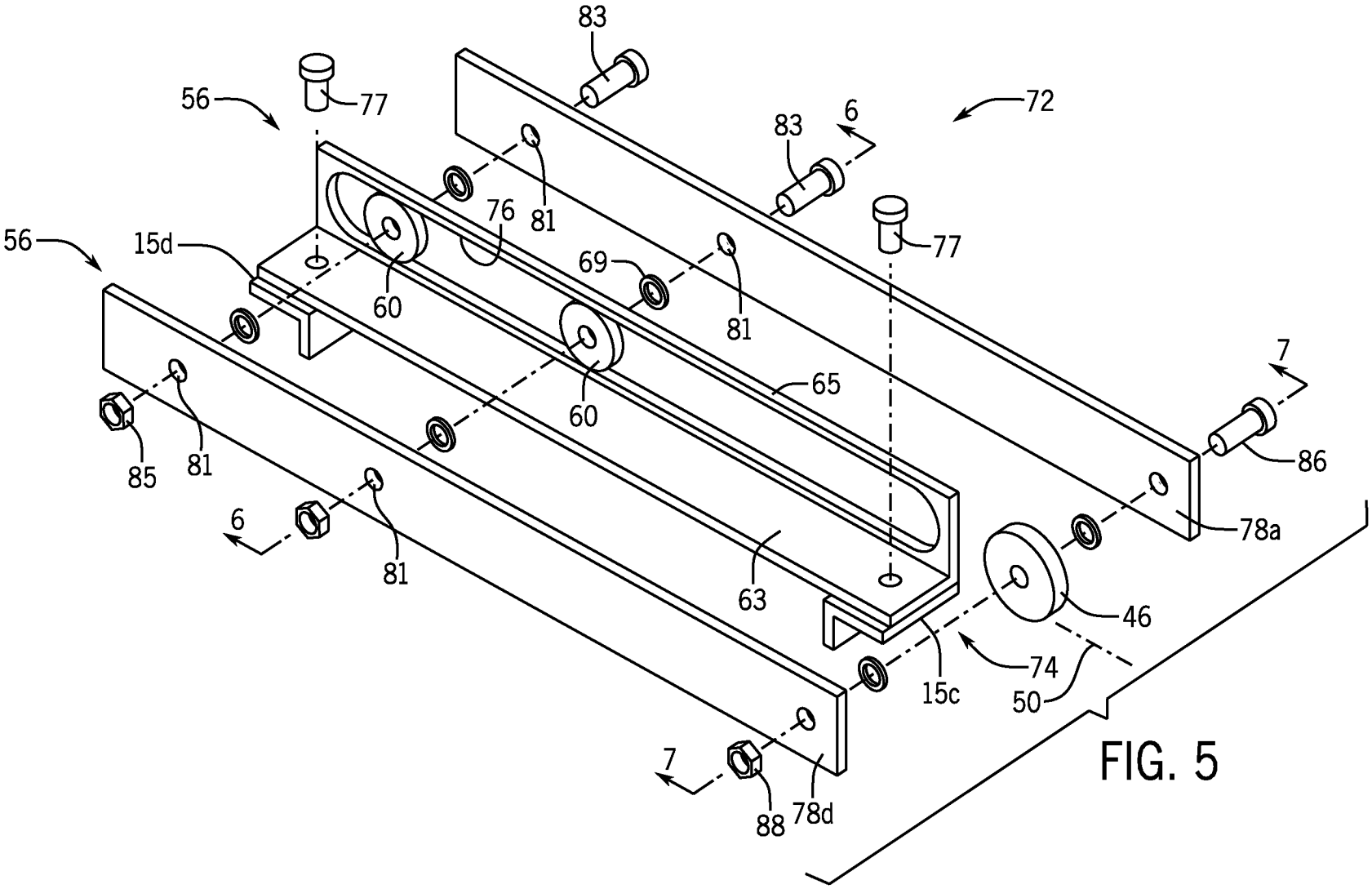
FIG. 5 is an exploded, perspective view of one assembly of one stabilizing arm showing a supporting track structure.
Figure 6:
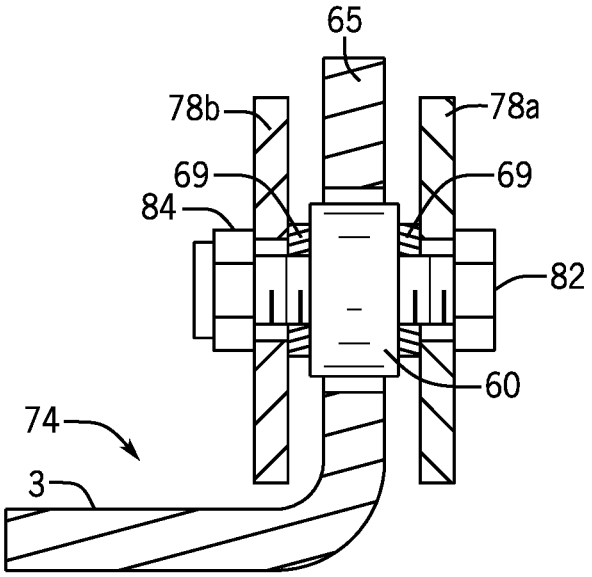
FIG. 6 is a cross-section of FIG. 5 along line 6-6, showing the tandem plates of the stabilizing arms.
Figure 7:
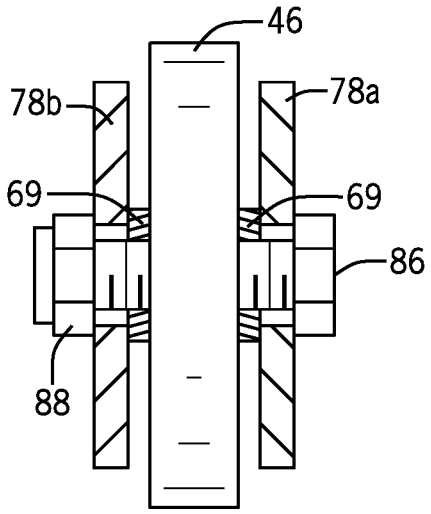
FIG. 7 is a cross-sectional view taken along line 7-7 of FIG. 5 showing the tandem plates flanking a distal roller for contact with the floor.

Referring now to FIGS. 5-7, in one embodiment of the invention, the stabilizer arms 56 are each supported by an independent track 72 that may be installed in a wide range of currently manufactured reclining chairs 10 as manufactured or in a retrofit capacity. Each track system 72 may, for example, provide for an L-shaped angle bracket 74 positioned to be extending parallel to the forward-axis 50 along the length of the base 12 on either side of the track traveler 64. A first web 63 of the angle bracket 74 may be positioned to extend horizontally with a first side positioned to abut an upper surface of the base 12 and be attached thereto by bolts 77 and tapped holes in the base 12 or with corresponding nuts (not shown). This positioning takes advantage of the space available in a large number of reclining chairs 10 and can be done on a retrofit basis by drilling the necessary holes or by providing adapters to allow the existing holes in a given base 12 to be utilized for this purpose.

A second web 65 of the angle bracket 74 may extend upward and may have a slot 76 extending parallel to the forward-axis 50 in size to receive therein the wheels 60 to guide those wheels in a straight line parallel to the forward-axis 50. A left and right tandem plate 78*a* and 78*b* may be positioned on flanking sides of the second web 65 of the angle bracket 74 and may incorporate two rearward holes 81 receiving bolts 83 that provide axles for the wheels 60. The axles are positioned to space the wheels 60 laterally to provide good leverage for torque resistance to the stabilizer arm 56 formed by these tandem plates 78. Nuts 85 may be attached to the bolts 83 as so installed passing through both of the tandem plates 78 to draw the flanking plates into close proximity to either side of the second web 65 to retain the wheels 60 within the slot 76 and to resist lateral torsion left to right on the stabilizer arms 56. To prevent friction between the plates 78 and the wheels 60, washers 69 may be placed between the plates and the wheels 60.

Figure 8:
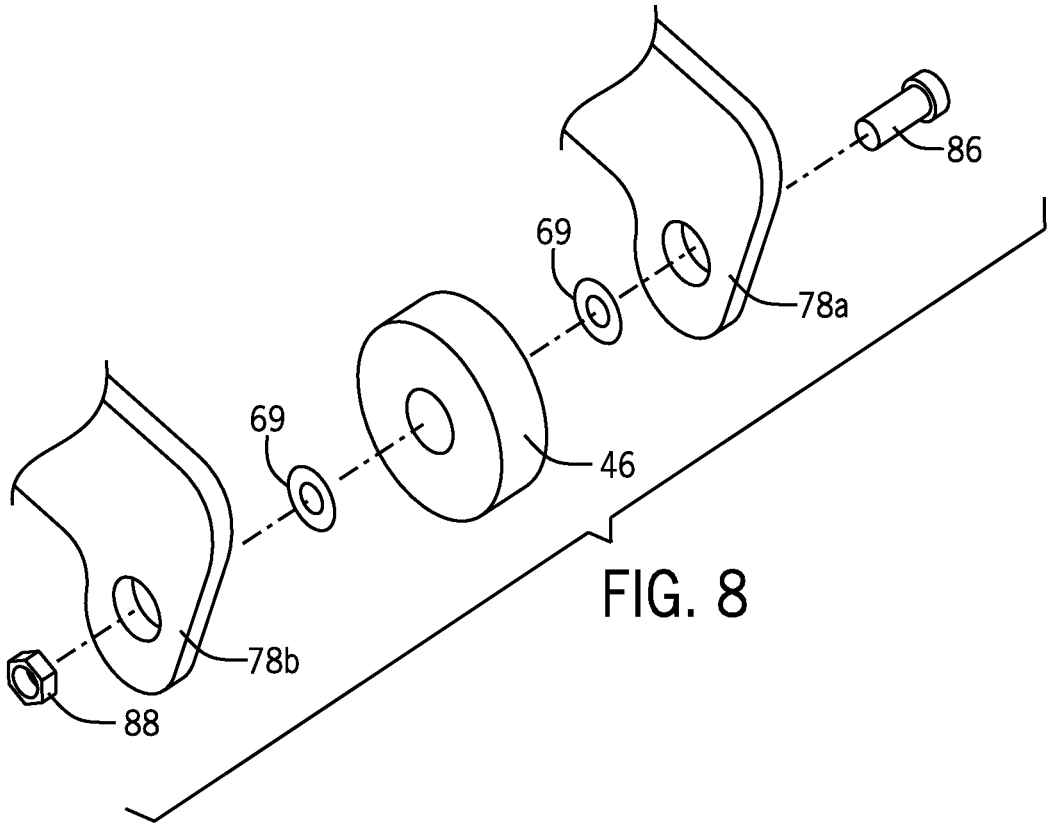
FIG. 8 is a fragmentary detail showing an alternative design of the tandem plates allowing vertical offset of the distal roller for improved compatibility with existing recliner chairs.

The distal rollers 46 may likewise be captured between distal ends of the tandem plates 78 and provided with an axle by a bolt 86 and corresponding nut 88 tightening the tandem plates 78 against the opposite sides of the distal rollers 46 spaced by washers 69 for free rotation of the distal rollers 46. These distal rollers 46 may be larger than the wheels 60 and sized so that they may extend downward into contact with the floor 16 despite the upward offset of the slot 76 by the intervening base 12 and angle bracket 74. Alternatively, as shown in FIG. 8, ends of the tandem plates 78 may be angled downwardly to displace the axle of distal rollers 46 vertically downward with respect to the axles of wheel 60 to provide a similar effect.

The use of spaced apart tandem plates 78 provides improved torsion resistance, and improved resistance to upward bending reducing the tendency of the chair to tip to its side.

Figure 9:
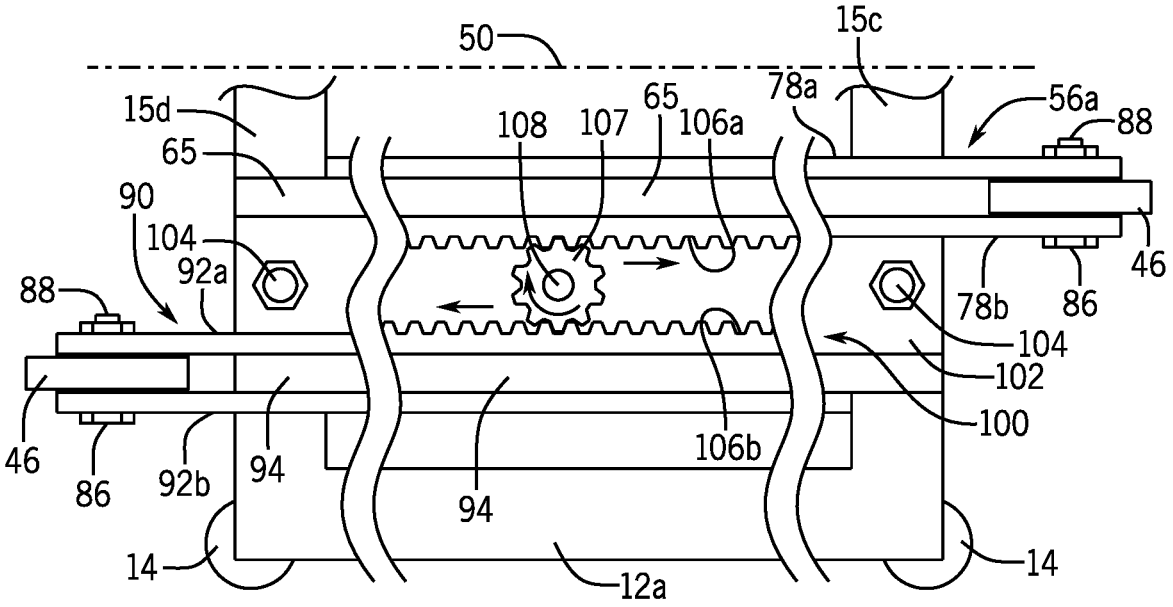
FIG. 9 is a fragmentary top plan view of the base of the chair shown in FIG. 3 providing for a forward- and rearward-facing track linked by a rack and pinion system so that the forwardly extending track causes the rearwardly extending track to extend simultaneously.
Figure 10:
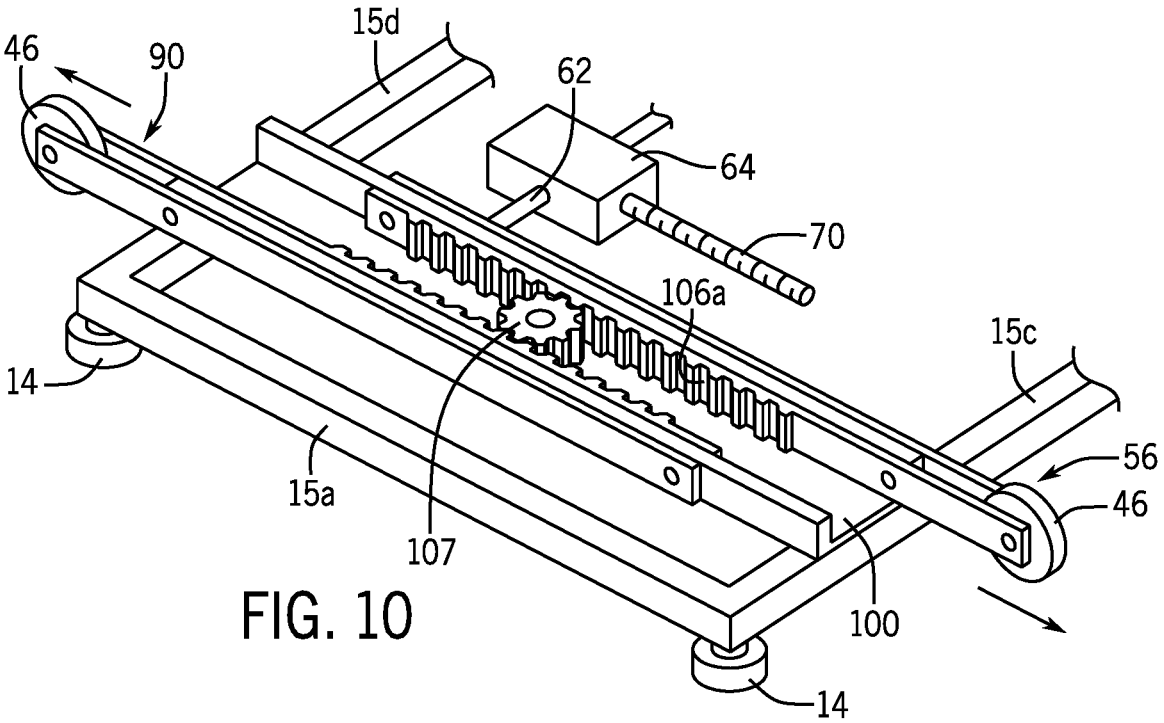
FIG. 10 is a fragmentary perspective view similar to FIG. 3 showing the double track system of FIG. 9 and the directions of extension forward and rearward from the chair.

Referring now to FIGS. 9 and 10, the present mechanism may be readily adapted to provide a forwardly extending stabilizer arm 56, as described above, operating in tandem with a rearwardly extending arm 90 that provides protection against the chair 10 tipping backwards as well as forward. The rearwardly extending arm 90 may be substantially identical to the forwardly extending stabilizer arm 56 described above, having its own distal roller 46 held by a bolt 86 and nut 88 between flanking plates 92*a* and 92*b*, the latter substantially identical to plates 78*a* and 78*b* however flipped 180 degrees about a vertical axis.

The plates 92*a* and 92*b* may flank a third web 94 extending upwardly like web 65 and parallel to web 65 but displaced rightward therefrom. In this case, both the third web 94 and web 65 may be upwardly extending webs of a common C-channel 100 having a spanning base 102 that may be bolted to the base 12 by bolts and nuts 104. The rearwardly extending arm 90 may have internal wheels 60 (not visible in the FIGS.) analogous to wheels 60 for stabilizer arm 56 and fitting within a corresponding slot 76 through the third web 94 and similar to the slot 76 in the second web 65.

Opposed inner and vertical faces of plates 78*b* and 92*b* may support corresponding racks 106*a* and 106*b* whose teeth extend toward each other separated by a gap that is filled by a pinion gear 107. The pinion gear 107 may be supported for free rotation on a vertical shaft 108 attached to the base 102 of the C-channel 100 and extending vertically therefrom about which the pinion gear 107 rotates. It will be appreciated that movement of the stabilizer arm 56 forward along axis 50 will cause a clockwise rotation of the pinion gear 107 in turn causing the rearwardly extending arm 90 to move rearwardly by an equal amount.

The pair of stabilizer arms 56 and 90 as shown in FIGS. 9 and 10 on the right side of the chair 10 may be repeated on the left side of the chair 10 in the manner of the stabilizer arm 56 described in the previous FIGS. to provide improved robustness and resistance to left and right tipping.

Figure 11:
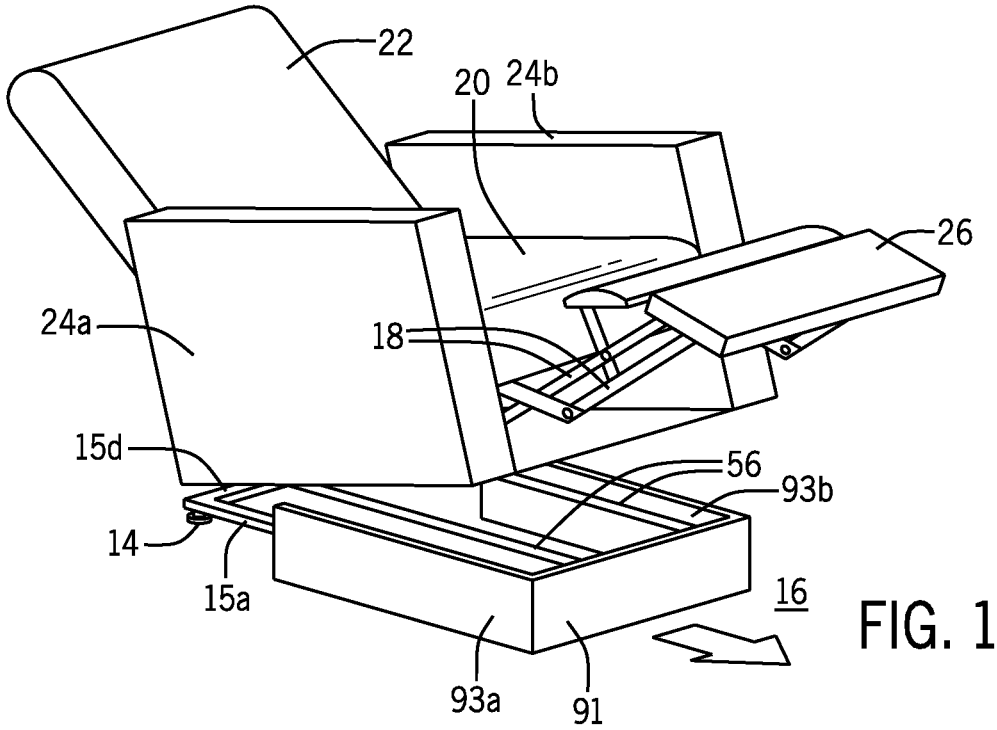
FIG. 11 is a figure similar to FIG. 1 showing a skirt wall placed around the stabilizing arms for improved aesthetics and force spreading.

Referring now to FIG. 11, in one embodiment the distal ends of the stabilizer arms 56 may support a front, vertically oriented panel 91 sized to extend across the left or right width of the base 12 perpendicular to the extent of the stabilizer arms 56. The left and right vertical edges of the front panel 91 attach to corresponding edges of rearwardly extending right and left side panels 93*a* and 93*b*, respectively, passing along an outside of frame bars 15*a* and 15*b* (visible in FIG. 3), respectively. The front panel 91 and left and right side panels 93*a* and 93*b* may move with the stabilizer arms 56 to provide a skirt surrounding the stabilizer arms 56 visually and blocking a region beneath the leg rest 26 to keep this area clear from loose objects that might interfere with the leg rest 26 during retraction. The front panel 91 may also provide an increased area of contact between the stabilizer arms 56 and the floor 16 for improved stability and support of the chair 10. Glides or wheels (not shown) may be installed on the lower edges of the front panel 91 and side panels 93 to reduce friction with the floor 16 during extension and retraction.

Figure 12:
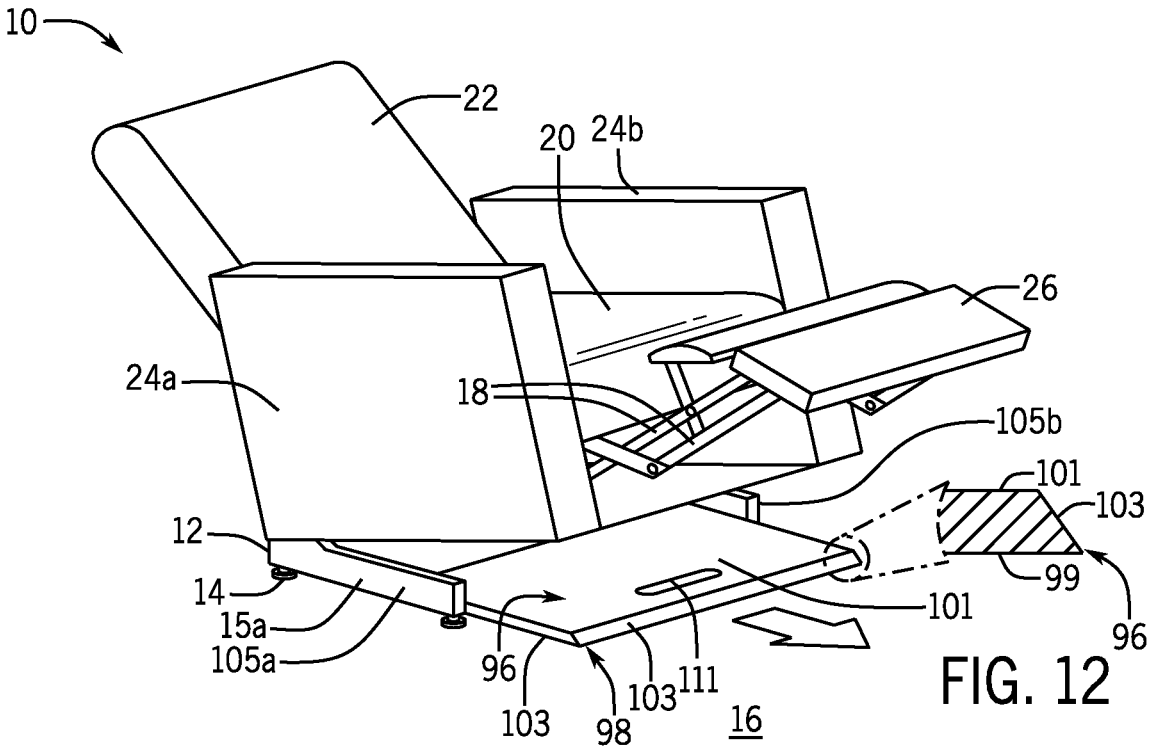
FIG. 12 is a figure similar to FIG. 1 showing an alternative design employing a low-profile panel providing a forward bracing with reduced interference with a user's or caregiver's feet and showing a fragmentary cross-section of that panel as in inset.

Referring now to FIG. 12 in an alternative embodiment, the stabilizer arms 56 may be replaced with a generally flat panel 96 presenting a planar lower surface 98 that may closely abut the floor 16 during extension of the panel 96 and an upper surface 101 providing a stable and sturdy surface that may be stepped on without consequence when the panel 96 is fully extended. Desirably the lower surface 98 and upper surface 101 of the panel are separated by a reduced height being less than 2 inches and desirably less than 1 inch. Edges 103 of the panel may be beveled to reduce the risk of a user's feet catching on those edges 103 when stepping onto the upper surface 101 of panel 96. The upper surface 101 of the panel 96 is preferably substantially continuous except for a handhold 111 which may be used to extend or retract the panel 96 when manual extension and retraction is desired.

Figure 13:
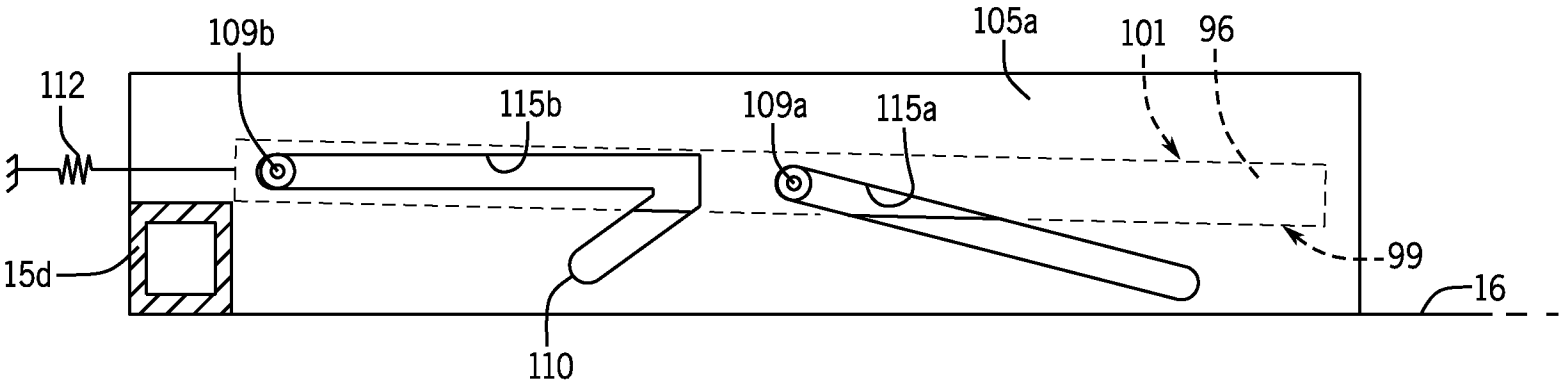
FIGS. 13 and 14 are fragmentary side views in phantom of the track assembly allowing retraction (FIG. 13) and extension (FIG. 14) of the low-profile panel of FIG. 12.

Referring now to FIG. 13, the panel 96 may fit within the left and right side vertically extending sleeves 105*a* and 105*b* attached to the base 12, for example, by bolts (not shown) or the like connecting with rear bar 15*d* and side bars 15*a* and 15*b*, respectively. In this embodiment, front bar 15*a* may be removed to eliminate interference with the panel 96.

Figure 14:
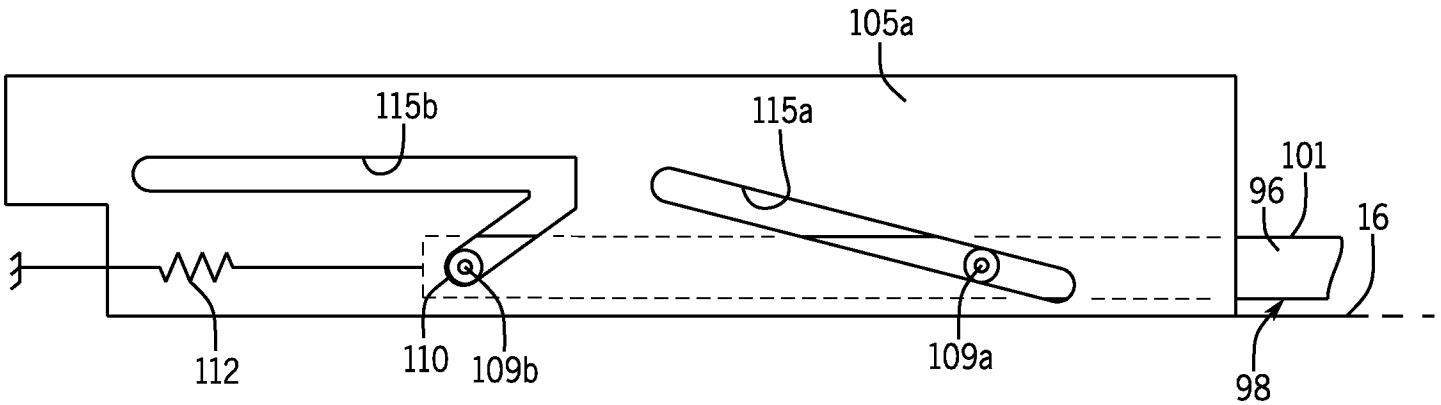

From each side of the panel 96, front and rear guide rollers 109*a* and 109*b* may extend leftwardly and rightwardly from the panel 96 to be received by corresponding front and rear slots 115*a* and 115*b* in the vertically extending sleeves 105*a* and 105*b*, respectively. The front slots 115*a* may angle downwardly so that the front edge of the panel 96 approaches the floor 16 at its full extension position to just contact the floor at that full extension position. The rear slot 115*b* may be substantially horizontal until its frontmost edge at which it may drop downwardly and hook rearwardly to a detent position 110. As shown in FIG. 14, when the rear roller 109 drops into the detent position, the panel 96 may be approximately horizontal and abut the floor over its entire lower surface 98. A restoring spring 112 attached to the rear edge of the panel 96 provides a rearward bias holding that panel in this lower horizontal position where the panel 96 may resist forward tipping of the chair 10.

The panel 96 may be retracted back under the chair 10 by pulling the panel 96 forward against the biasing spring 112 and guiding the rear roller 109*a* upward back into the horizontal upper portion of the rear slot 115*b* allowing full retraction of the panel 96. Other extraction and retention mechanisms are contemplated, and it will be understood from the above description that the panel 96 may also be attached to the recliner mechanism to extend automatically with movement of the recliner chair 10 between its reclined and upright positions.

Referring now to FIGS. 15, 16, and 17, in an alternative embodiment, the leg rest 26 may provide for a downwardly extending stilt 120 so that when the leg rest 26 is in an extended state as shown in FIG. 15 with the leg-supporting surface of the leg rest 26 extending generally horizontally with a cushion 122 upward, the stilt 120 is substantially perpendicular and vertically downwardly extending from a lower surface of the leg rest 26 to a point touching or closely adjacent to the floor 16. The stilt 120 may be rigidly attached to the leg rest 26, for example, using a cross brace 124 or may fold out from the leg rest 26 and be locked into position with the detent (not shown). As is generally understood in the art, the leg rest 26 is attached by means of the recliner linkage 18 which provides a pantograph or four bar linkage that moves the leg rest 26 into a substantially vertical position as the leg rest 26 is withdrawn to the retracted position close to the recliner chair 10 under the seat pan 20 as shown in FIG. 16. Generally, the pantograph linkage will include four linkage bars of 126*a* and 126*b* having first ends pivotally attached to the leg rest 26 at displaced locations along the leg rest 26, the space between these attachment locations defining linkage bar 126*c*. A final linkage bar 126*d* is pivotally attached to the remaining ends of linkage bars 126*a* and 126*b* completing the four-bar linkage. The four-bar linkage communicates with the remainder of the recliner linkage 18 through a continuation of bar 126*d* and by additional linkage bars 128 attached pivotally to the remaining end of linkage bar 126*a*.

When the leg rest 26 is in the retracted position, the stilt 120 swings rearwardly and horizontally to fit beneath the seat pan 20 by the action of the recliner linkage 18 while fixed relative to the leg rest 26. Referring also to FIG. 17 in the extended position shown also in FIG. 15 the stilt 120 prevents downward motion of the leg rest 26 while the recliner linkage 18 is in an extended position thus providing a bracing of the chair 10 against a forward tipping particularly if weight is placed on the leg rest 26. In this case, with weight placed directly on the leg rest 26, the stilt 120 absorbs that weight without the need for strength in the linkage 18 other than to hold the orientation of the leg rest 26.

Force-Limited Stabilizing Arm Connection

Figure 18:
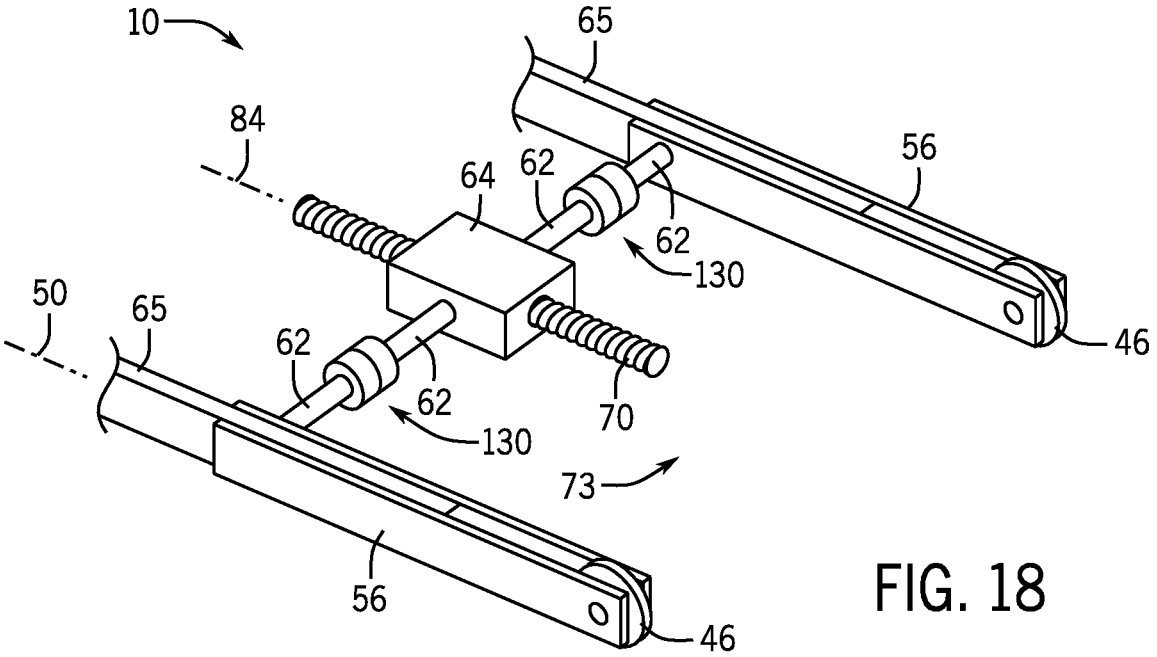
FIG. 18 is a figure similar to that of FIG. 3 showing the interposition of force-limiting couplers between the traveler and the extendable arm.

Referring now to FIG. 18, the extension of the wheel axle 62, or similar structure between the traveler 64 and the stabilizer arms 56, may be modified by the introduction of a force-limiting coupler 130 positioned to allow the stabilizer arms 56 to stop when confronting an obstruction that would prevent their extension or retraction, without stopping the traveler 64 or stalling the associated motor 73. By interposing such a force-limiting coupler 130 between the traveler 64 and each of the stabilizing arms 56, a single powerful motor may be used to operate the chair recliner mechanism while appropriately limiting the force applied to the stabilizer arms 56. In addition, the force-limiting coupler 130 prevents excessive force from being applied to the stabilizing arms 56 in a non-motorized reclining chair 10 where mechanical advantage of the linkage and momentum of the chair would otherwise produce such excessive forces.

Generally, each force-limiting coupler 130 will ensure tandem motion of the stabilizer arms 56 and traveler 64 in a coupled state and will retain that coupled state until a predetermined force has occurred, desirably about 40 pounds but typically in a range from 10 to 60 pounds or at least 20 pounds of force along the axis 50 measured at the stabilizer arms 56 when obstructed. Once that predetermined threshold force has been exceeded, the force-limiting coupler 130 allows the traveler 64 and stabilizer arms 56 to move independently (for example, allowing the stabilizer arms 56 to stop even though the traveler 64 is moving).

The force-limiting couplers 130 are further designed to automatically restore the stabilizer arms 56 and traveler 64 to their original state of attachment after the obstruction is removed or direction of the movement of the stabilizer arms 56 is reversed and after the chair 10 has cycled once between a reclined and upright position. This automatic restoration eliminates the need for manual reconnection or realignment of the stabilizer arms 56 and the traveler 64 or the need for access to the force coupler 130 which may be underneath the reclining chair 10.

Figure 19:
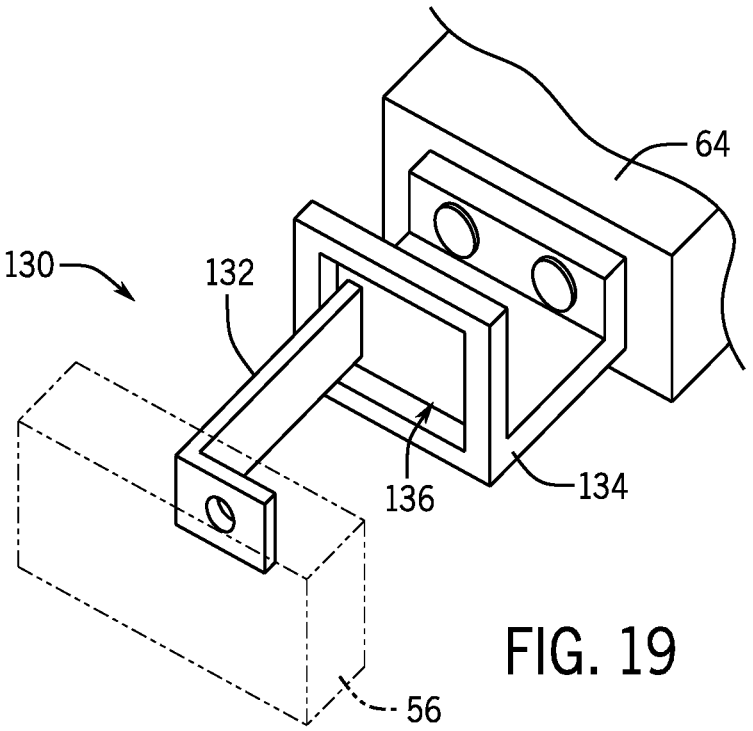
FIG. 19 is a perspective fragmentary view of one embodiment of the force-limiting coupler of FIG. 18 employing a flexibly engaged finger and socket.

Referring now to FIG. 19, in a first embodiment, the force-limiting coupler may provide a finger 132, for example, attached to an inward, side surface of the stabilizer arm 56 and extending laterally toward the traveler 64. This finger 132 provides a tooth that may be received by a socket 134 attached to the traveler 64 and providing an opening 136. Alternatively, the finger 132 may be attached to the traveler 64 and the socket 134 attached to the arm 56. The finger 132 may be fixedly attached (e.g., by a rivet), or removably attached to the arm 56 by a bolt or the like in order to be easily replaceable if the finger 132 is damaged. During normal operation, a distal end of the finger 132 is retained by the surrounding walls of the opening 136 so that motion of the traveler 64 parallel to axis 50 causes commensurate motion of the stabilizer arm 56. Generally, the opening 136 will be larger than the size of the distal end of the finger 132 to facilitate connection and reconnection of the finger 132 or socket 134 with flexure of either or both. In addition, the socket 134 will have an opening 136 with a vertical height higher than the vertical extent of the finger 132 to accommodate a divergence between the axis 50 and trajectory 84 discussed above with respect to the motion of the traveler 64 and the stabilizer arms 56. It will be appreciated from this description that, alternatively, the finger 136 may be rigid, and the socket 134 may be flexible/resilient to release the finger from engagement when force is exceeded in either direction.

Figure 20A:
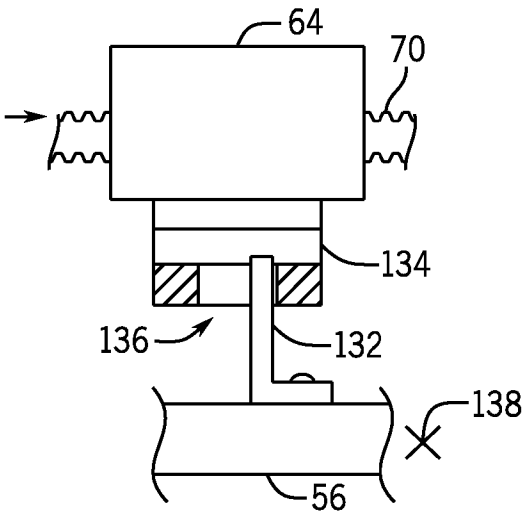
FIGS. 20*a*-20*c* are top plan fragmentary views of the coupler of FIG. 19 showing successive stages during a process of disconnection when the extendable arm is blocked in forward motion by an obstruction.
Figure 20B:
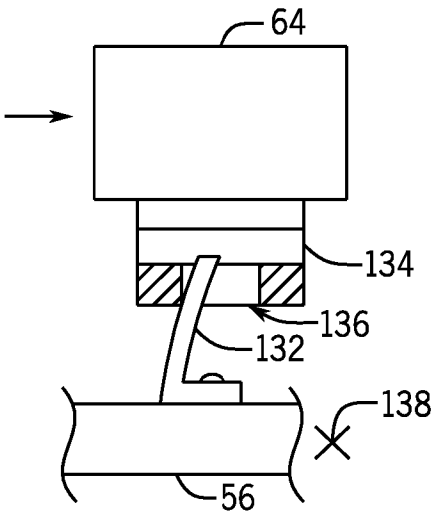
Figure 20C:
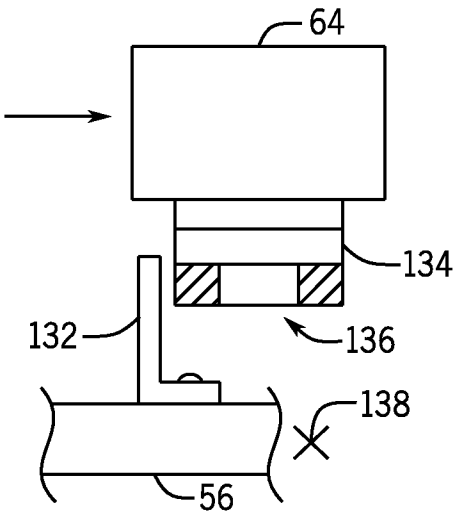

Referring now also to FIGS. 20*a-c*, the finger 132 and socket 134 may be engaged during normal operation, for example, during a forward motion shown in FIG. 20*a* when a leading edge of the stabilizer arm 56 contacts an obstruction 138, typically representing contact between distal roller 46 and an object on the floor but potentially being any obstruction of the stabilizer arm 56 in its forward motion that is either heavy or fixed and cannot be readily pushed out of the way by the stabilizer arms 56.

As shown in FIG. 20*b*, in one embodiment, the finger 132 may be a flexible and resilient material such as a spring steel (e.g., 1095 or 1075 blue tempered spring steel), or a plastic or composite with appropriate resilience and durability (e.g., a PEI plastic or a fiber-reinforced composite), to bend in cantilever so that with continued motion of the traveler 64, spring finger 132 flexes forwardly with the distal end following an inward radius toward the stabilizer arm 56. At a predetermined force, the distal end of the spring finger 132 passes out of the opening 136 and along the face of the socket 134 to release the socket 134 from the spring finger 132, fully disconnecting the stabilizer arm 56 from the traveler 64, as shown in FIG. 20*c*, so that the predetermined force is not exceeded. At this point the stabilizer arm 56 is substantially free to move and can be manually retracted or extended within its normal limits as will be discussed below. The predetermined force required for this disconnection may be calculated from the spring constant of the spring finger 132 and the geometry of its relationship to the socket 134 and opening 136 and may be set to be from 30 to 50 pounds. As a nonlimiting example, the spring finger 132 may have a length of at least 1 inch and preferably at least 2.5 inches, a thickness of less than ⅛ of an inch and preferably less than 1/16 inches or 0.05 inches (if metal) and less than a quarter inch if a polymer material, and a height of at least one quarter of an inch and preferably greater than ⅝ inches; and the opening 136 of the socket 134 may have a height of at least 0.5 inches and preferably 1.25 inches and may desirably be at least 50% taller than the height of the spring finger 132. The horizontal length of the socket 134 may be at least 1 inch and preferably at least 2.75 inches. As discussed above, the difference between the height of the spring finger 132 and the opening 136 of the socket 134 of about ⅝ inches accommodates a divergence between the axis 50 and the trajectory 84 with respect to the motion of the traveler 64 and the stabilizer arms 56. This accommodates a change in height of up to ⅝ inches of the finger 132 within the opening 136.

Figure 21A:
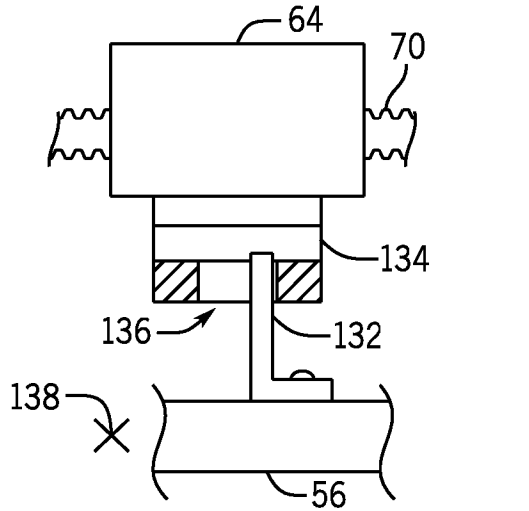
FIGS. 21*a-c* are figures similar to FIG. 20 showing successive stages in a process of disconnection when the extendable arm is blocked in rearward motion by an obstruction.
Figure 21B:
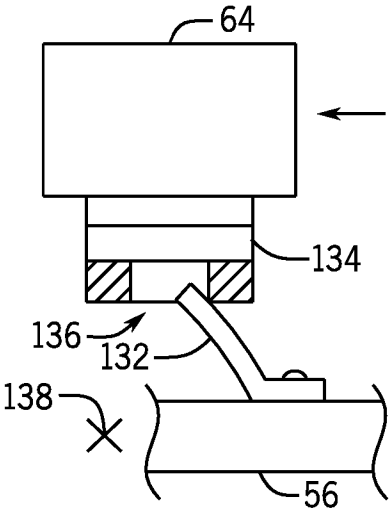
Figure 21C:
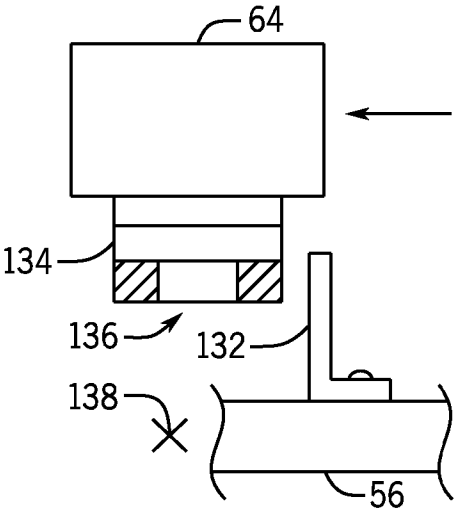

Referring now to FIGS. 21*a-c*, it will be appreciated that the flexibility of the finger 132 in its cantilevered configuration may be bidirectional, and accordingly the process described above with respect to FIG. 20*a-c* also applies to an obstruction 138 of a stabilizer arm 56 to rearward motion (e.g., an object caught between one or both distal rollers 46 and the base 12), where normal rearward motion is indicated at FIG. 21*a*, and the flexing of the finger 132 upon an obstruction to rearward motion in the stabilizer arm 56 is shown in FIG. 21*b*. As depicted in FIG. 21*b*, rearward flexure of the finger 132 again removes the distal end of the finger 132 from the socket 134 so that it may pass along the vertical face of the socket 134 until the socket 134 and finger 132 are disconnected as shown in FIG. 21*c*. Again, after disconnection the stabilizer arm 56 may move independently of the traveler 64.

Referring now to FIGS. 22*a-c* after the sequence of events depicted and described with respect to FIGS. 20*a-c*, the socket 134 may reconnect with the finger 132 by virtue of mechanical stops 140 limiting the motion of the stabilizer arms 56 in extension or retraction to a distance no more than and typically somewhat less than travel limits of the traveler 64. In the situation where a disconnection has occurred because of an obstruction preventing forward motion of the stabilizer arm 56 (per previously discussed FIGS. 20*a-c*), this reconnection will require a cycling of the traveler from the front of the chair 10 back to the rear of the chair (a cycle). As the traveler 64 moves rearwardly as indicated by FIG. 22*a*, an outer periphery of the opening 136 of the socket 134 will contact the spring finger 132 outside of the opening 136 and push the spring finger 132 and attached stabilizer arm 56 rearward until stabilizer arm 56 is stopped by stop 140. As indicated by FIG. 22*b*, at this point, the traveler 64 may continue to move rearwardly causing a flexure of the spring finger 132 to move its distal end in a radius backward toward the stabilizer arm 56 until the distal end of the spring finger 132 slides along the inner vertical face of the opening 136 and snaps back into the opening 136 as shown in FIG. 22*c*. Assuming any obstructions have been removed, the stabilizer arm 56 may then move in tandem with the traveler 64 during the forward and backward strokes from that point on.

Similarly, in the case of a rearward obstruction (as discussed previously in FIGS. 21*a-c*), a forward stop 142 limiting the motion of the stabilizer arm 56 will allow a forward cycle of the traveler 64 from its rearmost position to its frontmost position (a cycle) to move the stabilizer arm 56 against its forward stop 142 by a force of contact between an outer rim of the opening 136 and the largely un-flexed finger 132. Then again, continued forward motion of the traveler 64 flexes the distal end of the finger 132 in a radius toward the stabilizer arm 56 so that it may slip past the walls of the opening 136 and be received within the opening 136 as shown in FIG. 23*c*. Again assuming the obstruction 138 has been removed, normal operation of 10 the motion between the traveler 64 and stabilizer arm 56 is now restored.

Figure 24:
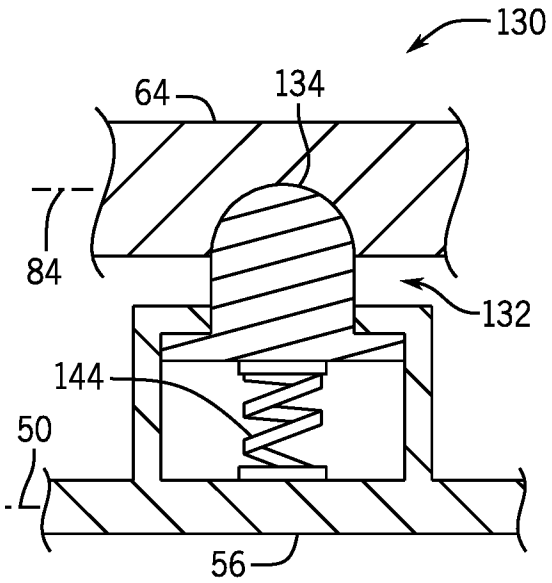
FIG. 24 is a plan fragmentary cross-sectional view of an alternative coupler using an axially biased spring finger received within a socket.

Referring now to FIG. 24, it will be appreciated that the finger 132 and socket 134 may be generalized, for example, with the socket 134 being a depression into which a spring loaded finger 132, for example, under bias of a helical compression spring 144 in a direction perpendicular to axis 50, engages and disengages with that socket 134 as described above. In this case, a perpendicular biasing instead of an axially biased cantilevered leaf spring is employed. More generally it will be appreciated that in an alternative, socket 134 may be axially biased with the fingers 132 rigidly attached to the stabilizer arm 56 to similar effect and, of course, that the locations of the socket 134 and finger 132 on the traveler 64 and stabilizer arm 56 may be reversed.

Figure 25:
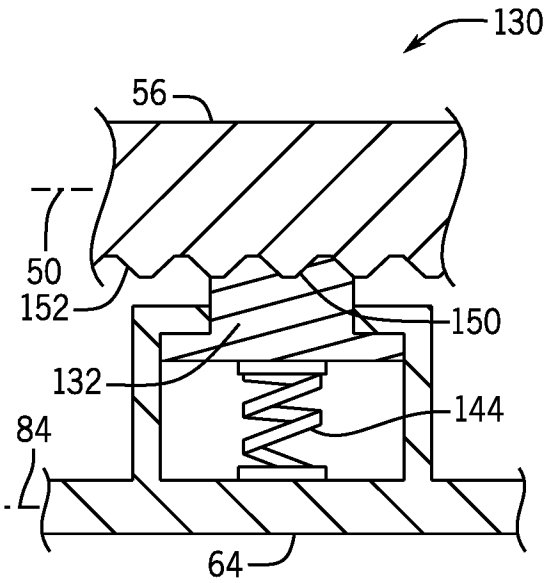
FIG. 25 is a figure similar to that of FIG. 24 showing a coupler providing extended engagement by means of nesting teeth between the traveler 64 and the extendable arm that is nevertheless force-limited.

Referring now to FIG. 25 in a variation of the embodiment described above, localized engagement between the socket 134 and finger 132 can be replaced with an extended, force-limiting sliding connection that maintains constant engagement between the traveler 64 and the stabilizer arms 56. For example, in one embodiment shown in FIG. 25, the finger 132 of FIG. 24 may be provided with serrations or teeth 150 engaging corresponding teeth 152 distributed along the axis 50, for example, in the manner of a rack with vertically extending teeth extending substantially the full length of travel of the stabilizer arms 56. In this respect, the finger 132 is desirably attached to the traveler 64 and the rack of teeth 152 attached to the stabilizer arms 56. Independent motion between the traveler 64 and the stabilizer arm 56 will occur after predetermined force between these elements is exceeded which causes a compression of the helical compression spring 144 allowing disengagement of the teeth 150 and 152 in a ratcheting progression. The predetermined force may be set by adjustment of the force of the biasing spring 144 knowing the geometry of the teeth 152 and 150 (depth and slope). In this embodiment, the force-limiting coupler 130 of FIG. 25 limits the force on the stabilizer arms 56 as desired by a sliding action.

Figure 26:
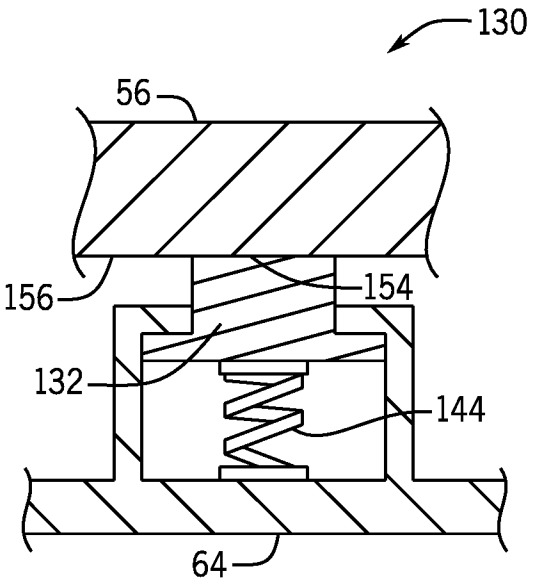
FIG. 26 is a figure similar to that of FIG. 25 showing a replacement of the nesting teeth with interengaging frictional surfaces.

Referring now to FIG. 26, in a further embodiment, the spring finger 132 may present a frictional surface 154 attached to the traveler and sliding against an axially extended frictional surface 156 attached to the stabilizer arms 56. In this case, the predetermined force of the force-limiting coupler 130 is determined by the static friction between these frictional surfaces controlled by the force of the axial biasing spring 144.

Figure 27:
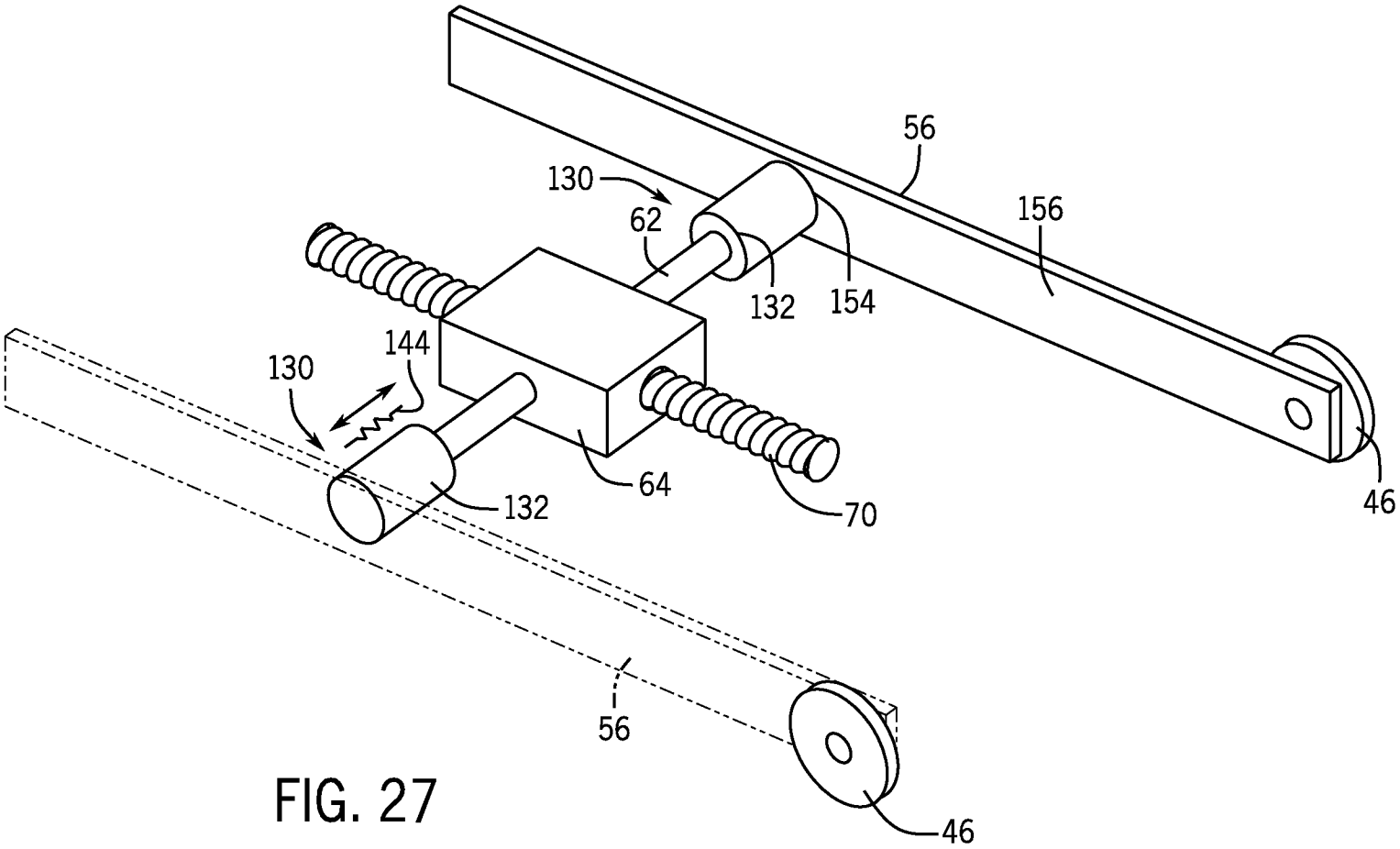
FIG. 27 is a figure similar to that of FIG. 18 showing extended engagement between the force-limiting couplers using the elements of FIG. 25 or 26.

The embodiments of FIGS. 25, 26, and 27 differ from the previous embodiments of the force-limiting coupler 130 in that the stabilizer arm 56 is not disconnected from the traveler 64 after the predetermined force has been exceeded which may be desirable to prevent unrestrained motion of the stabilizer arm 56. Nevertheless, when an obstruction is removed and the predetermined force is no longer exceeded, the stabilizer arm 56 and traveler 64 will no longer be positionally registered (that is, the components of the force-limiting coupling attached, respectively, to the stabilizer arm 56 and the traveler 64 may be in any of a range of relative positions).

Figure 28:
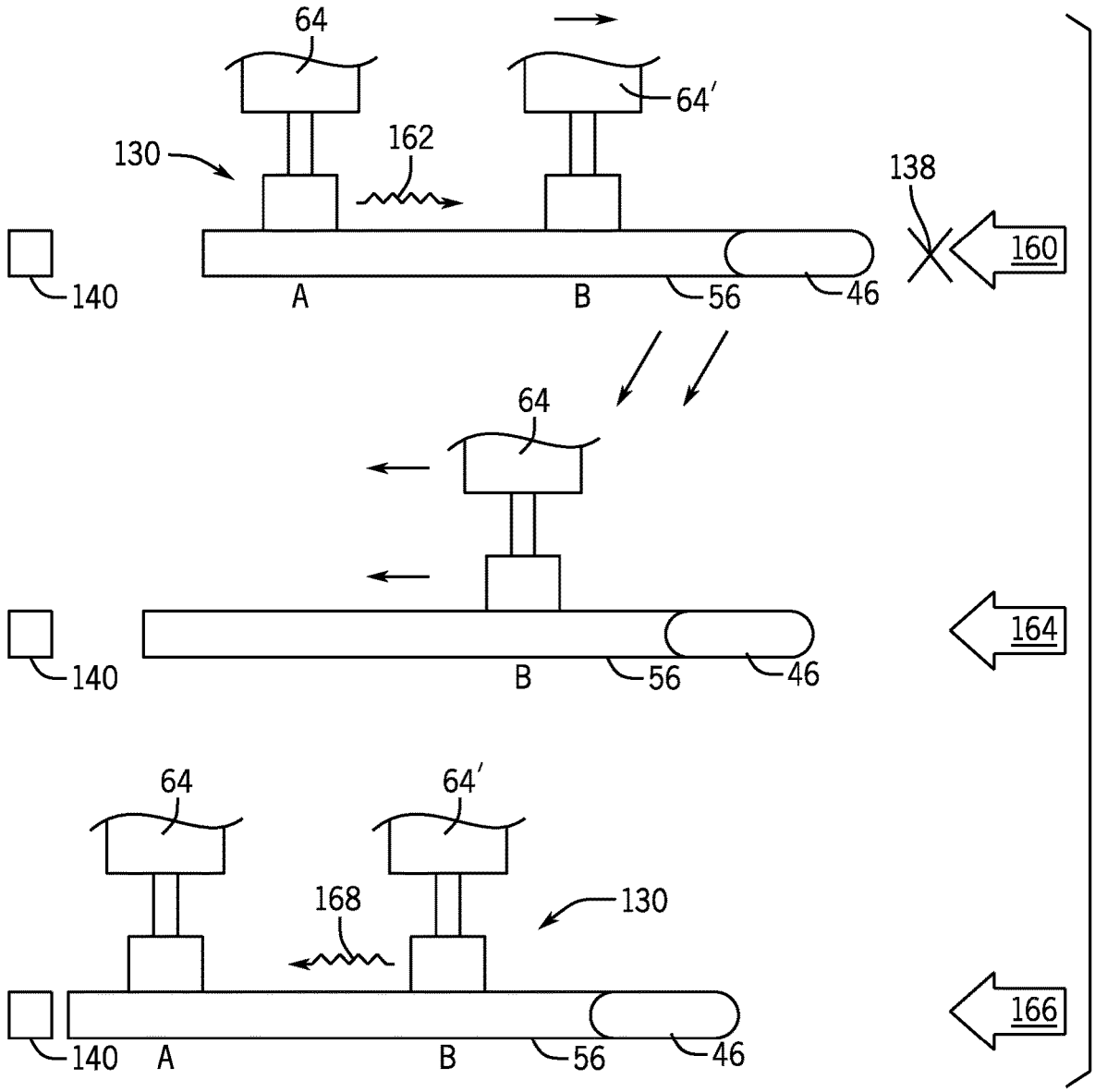
FIG. 28 is a simplified top plan view of the force-limited couplers of FIGS. 25 and 26 in three successive stages of forward motion of a stabilizing arm being blocked by obstruction, a rearward cycling of the traveler after obstruction, and a restoration of registration between the traveler and the stabilizing arm.

Referring now to FIG. 28, this mis-registration can be corrected, however, after a full cycling of the traveler 64 from front to back or from back to front. In the example of FIG. 28 which can be extended both to forward and reverse obstructions, in a first state 160, forward motion of the stabilizer arm 56 may confront an obstruction 138 causing the force-limiting coupler 130 between the traveler 64 in the stabilizer arm 56 to slide or ratchet as indicated by arrow 162 from its registered position A, forward along the stabilizer arm 56 by an amount dependent on the location of the obstruction 138 to an unregistered position B. The force-limiting coupler 130 may be any of those described with respect to FIGS. 25, 26, and 27.

As indicated by state 164, after such an obstruction which causes a mis-registration between the traveler 64 and the stabilizer arm 56, a reversal of the motion of the traveler 64 pulls both the stabilizer arm 56 and traveler 64 rearwardly in an unregistered configuration B under the force of friction or engaging teeth. As indicated by state 166, with continued rearward motion, the stabilizer arm 56 will strike the stop 140 while the traveler 64 continues rearward motion. In this situation, the predetermined force of the force-limiting couplers 130 will be to slide relative, as indicated by arrow 68, to each other overcoming friction or teeth engagement. This sliding of arrow 168 causes the stabilizer arm 56 and traveler 64 to move back from the unregistered position B to its original registration position A. Thus, in this embodiment, force-limiting coupler 130 both allows independent motion of the traveler 64 and stabilizer arm 56 when confronting an obstruction but also resets itself after one cycle once the obstruction is no longer in play.

It will be appreciated that these general principles can be implemented, for example, also with other attachment mechanisms, including magnetic attraction serving in lieu of the frictional engagement, or hook and loop fastener structures and the like operating as a replacement for the finger 132 and socket 134 of FIG. 19. A magnet may be used to increase the frictional force, or may be in lieu of the frictional surface. A magnet may not require a spring to bias the frictional surfaces together, since the magnet is attracted to the surface via magnetism. Desirably the force-limiting coupler 130 does not store energy that would tend to cause the stabilizer arm 56 to spring forward or backward abruptly, for example, if the stabilizer arm 56 and traveler 64 were simply connected together by a compliant spring.

The inventors contemplate but do not currently claim a variety of alternative mechanisms for dealing with obstructed extension arms 56 including sensors for sensing such an obstruction and deactivating the recliner chair motor. The sensors could include, for example, optical sensors or limit switches attached to bumpers that contact obstructions and that may activate a break or disconnect the motor driving the reclining chair 10. The inventors have also contemplated the use of separate motors for moving the reclining mechanism of the chair 10 and the extension arms 56 such that the motor associated with the extension arm 56 is sized to stall when an obstruction is encountered. Similarly breakaway elements that irreversibly separate upon excess force application, cushioning bumpers or spring-loaded connections which allow energy and force to be reduced by compression of a resilient element and the like, are contemplated.

The use of the term chair should be understood broadly to include furniture that functions as a chair including, for example, couches, sectionals, and the like. The term recliner should be broadly understood to describe incliners and the like.

Certain terminology is used herein for purposes of reference only, and thus is not intended to be limiting. For example, terms such as "upper", "lower", "above", and "below" refer to directions in the drawings to which reference is made. Terms such as "front", "back", "rear", "left", "right", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

We claim:

1. A reclining chair comprising:

a base frame;

a seat pan, a seat back, and leg rest, the leg rest intercommunicating by a linkage supported by the base frame to move the leg rest between a retracted position with the leg rest at a rearmost position near the base frame and an extended position with the leg rest extended forwardly away from the base frame; and at least one extendable arm supported by the base frame and having a distal end movable between a retracted position and an extended position in which the distal end moves forward from the base frame so that the distal end contacts a floor surface to resist forward tipping of the base frame on the floor;

wherein the at least one extendable arm communicates with the linkage through a force-limiting coupler operating to provide independent movement of the linkage and the extendable arm when a predetermined coupling force is exceeded and to provide a restoration of tandem motion of the linkage after the predetermined coupling force is no longer exceeded.

2. The reclining chair of claim 1 wherein the predetermined force is between 30 and 50 pounds of force on the extendable arm.

3. The reclining chair of claim 1 wherein the linkage includes a traveler moving between a first and second position corresponding to the extended and retracted position of the reclining chair, and wherein the force-limiting coupler communicates between the traveler and the extendable arm allowing the traveler and the at least one extendable arm to move in tandem when the predetermined coupling force is not exceeded, and wherein the extendable arm is constrained by stops against further motion when the traveler is in the first or second position.

4. The reclining chair of claim 1 wherein the force-limiting coupler disconnects the linkage and the at least one extendable arm when the predetermined coupling force is exceeded and reconnects the linkage and the extendable arm when the predetermined coupling force is no longer exceeded and after one cycle of the reclining chair between the retracted position and extended position is completed.

5. The reclining chair of claim 4 wherein the force-limiting coupler is an inter-engaging finger and socket having a spring-biased connection released at the predetermined force.

6. The reclining chair of claim 5 wherein at least one of the finger and socket flex along a direction of travel of the extendable arm as a function of the coupling force to disconnect the finger and socket when the predetermined coupling force is exceeded.

7. The reclining chair of claim 5 wherein the socket provides an opening larger in a vertical extent than a received portion of the finger to allow a predetermined relative vertical displacement between the socket and finger while connected.

8. The reclining chair of claim 1 wherein the force-limiting coupler provides a force-limited sliding between the linkage and the at least one extendable arm from a registered to an unregistered position when the predetermined coupling force is exceeded and returns the linkage and the at least one extendable arm to the registered position when the predetermined coupling force is no longer exceeded and one cycle of the reclining chair between the retracted position and extended position is completed.

9. The reclining chair of claim 8 wherein the force-limiting coupler provides frictional surfaces attached respectively to the linkage and extendable arm and spring biased into frictional engagement.

10. The reclining chair of claim 8 wherein the force-limiting coupler provides at least one tooth attached to one of the linkage and extendable arm and spring biased into engagement with an other of the linkage and extendable arm.

11. The reclining chair of claim 1 including two extendable arms each having an independent corresponding force-limiting coupler.

12. The reclining chair of claim 1 further including a motor communicating with the linkage and actuable to move the reclining chair between the retracted position and extended position.

* * * * *